US009822728B2

(12) United States Patent
Hiratsuka et al.

(10) Patent No.: US 9,822,728 B2
(45) Date of Patent: Nov. 21, 2017

(54) ENGINE AND PISTON

(71) Applicants: AISIN SEIKI KABUSHIKI KAISHA, Kariya-shi (JP); AKROS CO., LTD., Komaki-shi (JP)

(72) Inventors: Ichiro Hiratsuka, Nagoya (JP); Takuya Niimi, Handa (JP); Yusuke Ikai, Nukata-gun (JP); Kazuki Saai, Nagoya (JP)

(73) Assignees: AISIN SEIKI KABUSHIKI KAISHA, Kariya-shi (JP); AKROS CO., LTD., Komaki-shi (JP)

( * ) Notice: Subject to any disclaimer, the term of this patent is extended or adjusted under 35 U.S.C. 154(b) by 155 days.

(21) Appl. No.: 14/420,769

(22) PCT Filed: Aug. 8, 2013

(86) PCT No.: PCT/JP2013/004787

§ 371 (c)(1),
(2) Date: Feb. 10, 2015

(87) PCT Pub. No.: WO2014/024494

PCT Pub. Date: Feb. 13, 2014

(65) Prior Publication Data

US 2015/0204269 A1 Jul. 23, 2015

(30) Foreign Application Priority Data

Aug. 10, 2012 (JP) ..... 2012-177894

(51) Int. Cl.
*F02F 11/00* (2006.01)
*F02F 3/14* (2006.01)
(Continued)

(52) U.S. Cl.
CPC *F02F 3/14* (2013.01); *F01L 3/04* (2013.01); *F02B 77/11* (2013.01); *F02F 1/24* (2013.01);
(Continued)

(58) Field of Classification Search
USPC ..... 123/193.3; 92/172
See application file for complete search history.

(56) References Cited

U.S. PATENT DOCUMENTS 4,398,527 A 8/1983 Rynbrandt
2008/0087255 A1 4/2008 Aoyama et al.
(Continued)

FOREIGN PATENT DOCUMENTS

JP 57 73843 5/1982
JP 60 184950 9/1985
(Continued)

OTHER PUBLICATIONS

Machine Translation of JP 2012072749 A PDF File Name: "JP2012072749A_Machine_Translation.pdf".*
(Continued)

*Primary Examiner* — Carlos A Rivera
*Assistant Examiner* — Ruben Picon-Feliciano
(74) *Attorney, Agent, or Firm* — Oblon, McClelland, Maier & Neustadt, L.L.P.

(57) ABSTRACT

Any one or more members of an engine, that is, a piston, a cylinder head and a valve, has a wall face disposed face-to-face to a combustion chamber, and the wall face is coated by a heat-insulation coating film. The heat-insulation coating film includes a heat-insulative layer formed on a surface of the wall face, and an inorganic-system coated-film layer formed on a surface of the heat-insulative layer. The heat-insulative layer includes a resin, and first hollow particles buried inside the resin and exhibiting an average particle diameter being smaller than a thickness of the heat-insulative layer. The inorganic-system coated-film layer includes an inorganic compound.

13 Claims, 4 Drawing Sheets

(51) Int. Cl.

| | |
|---|---|
| ***F02F 1/24*** | (2006.01) |
| ***F02B 77/11*** | (2006.01) |
| ***F01L 3/04*** | (2006.01) |
| *F02F 1/00* | (2006.01) |
| *F02F 3/10* | (2006.01) |

(52) U.S. Cl.
CPC . *F02F 1/00* (2013.01); *F02F 3/10* (2013.01); *F05C 2251/048* (2013.01)

(56) References Cited

U.S. PATENT DOCUMENTS

| | | | | |
|---|---|---|---|---|
| 2012/0042859 | A1 | 2/2012 | Sakai | |
| 2012/0082841 | A1 | 4/2012 | Kadoshima et al. | |
| 2015/0040879 | A1* | 2/2015 | Tomita | F02F 3/10 123/668 |

FOREIGN PATENT DOCUMENTS

| | | | |
|---|---|---|---|
| JP | 2005 76471 | | 3/2005 |
| JP | 2008 175163 | | 7/2008 |
| JP | 2008175163 | A * | 7/2008 |
| JP | 2008 200922 | | 9/2008 |
| JP | 2009 30458 | | 2/2009 |
| JP | 2009-243355 | A | 10/2009 |
| JP | 2009 298127 | | 12/2009 |
| JP | 2010 71134 | | 4/2010 |
| JP | 2010 185290 | | 8/2010 |
| JP | 2010 228223 | | 10/2010 |
| JP | 2010 249008 | | 11/2010 |
| JP | 2012 72746 | | 4/2012 |
| JP | 2012 72749 | | 4/2012 |
| JP | 2012072749 | A * | 4/2012 |
| JP | 2012 172619 | | 9/2012 |

OTHER PUBLICATIONS

Machine Translation of JP 2008175163 A PDF File Name: "JP2008175163A_Machine_Translation.pdf".*

International Search Report dated Sep. 17, 2013 in PCT/JP13/004787 filed Aug. 8, 2013.

Notification of Reasons for Refusal dated May 10, 2016 in Japanese Patent Application No. 2014-529318 (with English language excerpt translation).

* cited by examiner

70 : Nanometer-size Hollow Particles

ENGINE AND PISTON

TECHNICAL FIELD

The present invention relates to an engine whose combustion chamber is enhanced in the heat-insulating property, and a piston.

BACKGROUND ART

An engine comprises: a cylinder block having a bore; a piston fitted into the bore to be capable of reciprocating therein so as to form a combustion chamber therein; a cylinder head having a valve bore closing the combustion chamber and communicating with the combustion chamber; and a valve opening and closing the valve bore. In order to upgrade fuel consumption or mileage, it is preferable to enhance the combustion chamber in the heat-insulating property. In particular, in vehicles intending to upgrade the mileage, such as hybrid vehicles or vehicles provided with an idling stop function, driving the engine is sometimes brought to a halt temporarily during travelling the vehicles, or during bringing the vehicles to a halt temporarily. Under the circumstances, since the temperatures in the combustion chamber of the engine tend to drop, there are limitations in upgrading the mileage of the engine.

Patent Literature No. 1 discloses a piston in which a low thermal-conductive member is coated on a top face of the piston body. In the literature, the low thermal-conductive member is formed of a metallic material (such as titanium) whose thermal conductivity is lower than that of an aluminum material forming the piston body, and air films for heat insulation are further formed between the low-thermal conductive member and the piston body's top face. Patent Literature Nos. 2 and 3 disclose an engine, in which a heat-insulative material is formed on the top face of a piston by thermal spraying ceramic, respectively. Patent Literature No. 4 discloses a painted metallic plate made by forming a heat-insulative painted layer, which has hollow particles with an average particle diameter of from 5 to 27 μm therein, onto a surface of the metallic plate. Patent Literature No. 5 discloses a technique for forming an anode-oxidized coated film, whose porosity is 20% or more, onto an inner face of an engine's combustion chamber. Patent Literature No. 6 has mentions on a heat-insulative film in which a resinous material and hollow particles with an average particle diameter of from 5 to 15 nanometers are blended.

However, in Patent Literature No. 1, aluminum used for the piston has a specific gravity of 2.7, a thermal conductivity of 130 W/mK, and a thermal-expansion coefficient of $23\times10^{-6}/°$ C.; whereas titanium used for the heat-insulative material has a specific gravity of 4.5, a thermal conductivity of 17 W/mK, and a thermal-expansion coefficient of $8.4\times10^{-6}/°$ C. In order to demonstrate sufficient heat insulation with the heat-insulative material comprising titanium, it is necessary to make the heat-insulative material have a thickness on an order of millimeter. On the contrary, titanium is heavier than aluminum. Hence, when titanium is used for the heat-insulative material, it results in a weight increment for the piston reciprocating at high speeds, thereby hindering upgrading the mileage. Moreover, due to the weight and thickness of the heat-insulative material, and due to the differences between the thermal-expansion coefficients of the heat-insulative material and piston, it is not possible to maintain the strength in a joined face between the heat-insulative material and the piston.

In Patent Literature Nos. 2 and 3, since heat-insulative materials comprising thermal-sprayed ceramic are used, the face subjected to the thermal spraying has been more roughened after the thermal-spraying treatment than before the thermal-spraying treatment. When a heat-insulative material comprising thermal-sprayed ceramic is formed on the top face of a piston, protrusions with fine surface roughness turn into heat spots making the factor of ignition, so that they are likely to become the cause of knocking in engine. Moreover, since a heat-insulative material comprising thermal-sprayed ceramic is hard, it is difficult to do post-processing to the heat-insulative material.

When the painted metallic plate disclosed in Patent Literature No. 4 is used for internal combustion engine, it has limitations in the blending amount of the hollow particles within the painted film formed on the metallic plate's surface.

Although Patent Literature No. 5 contains mentions on a heat-insulative film made by an anode-oxidation treatment, the face subjected to the treatment has been more roughened after the treatment than before the treatment. Accordingly, when the top face of a piston is subjected to the anode-oxidation treatment, protrusions with fine surface roughness turn into heat spots making the factor of ignition, so that they are likely to become the cause of knocking in engine. The heat-insulative film disclosed in Patent Literature No. 6 comprises hollow particles and a resinous material, but has limitations in the heat-insulating property and strength of the coated film in order to maintain the film's formability. Moreover, the heat-insulative film's heat resistance is insufficient.

Hence, the present inventors have been seeking earnestly for ways in order for forming heat-insulation coating films provided with higher heat-insulating property and higher superficial flatness/smoothness. In recent years, it has been required for heat-insulation coating films to deal with engines with a higher compression ratio. Under such circumstances, it has been needed more and more to enhance heat-insulative films in the superficial flatness/smoothness as well as in the heat-insulating property.

RELATED TECHNICAL LITERATURE

Patent Literature

Patent Literature No. 1: Japanese Unexamined Patent Publication (KOKAI) Gazette No. 2005-76471;

Patent Literature No. 2: Japanese Unexamined Patent Publication (KOKAI) Gazette No. 2009-30458;

Patent Literature No. 3: Japanese Unexamined Patent Publication (KOKAI) Gazette No. 2010-71134;

Patent Literature No. 4: Japanese Unexamined Patent Publication (KOKAI) Gazette No. 2010-228223;

Patent Literature No. 5: Japanese Unexamined Patent Publication (KOKAI) Gazette No. 2010-249008; and Patent Literature No. 6: Japanese Unexamined Patent Publication (KOKAI) Gazette No. 2012-172619 (i.e., Japanese Patent Application No. 2011-036501)

SUMMARY OF THE INVENTION

Problems to be Solved by the Invention

The present invention has been done in view of the actual circumstances mentioned above. Accordingly, it is an object to provide an engine and piston that suppress knocking to be able to contribute to upgrading mileage because of comprising a heat-insulation coating film provided with higher heat-insulating property and higher superficial flatness/smoothness.

Means for Solving the Problems (1) An engine directed to the present invention is an engine equipped with a cylinder block having a bore; a piston fitted into said bore to be capable of reciprocating therein so as to form a combustion chamber therein; a cylinder head having a valve bore closing said combustion chamber and communicating with said combustion chamber; and a valve opening and closing said valve bore;

any one or more members of said piston, said cylinder head and said valve having a wall face disposed face-to-face to said combustion chamber, the wall face coated by a heat-insulation coating film;

said heat-insulation coating film comprising: a heat-insulative layer formed on a surface of said wall face; and an inorganic-system coated-film layer formed on a surface of the heat-insulative layer;

said heat-insulative layer comprising: a resin; and first hollow particles buried inside the resin and exhibiting an average particle diameter being smaller than a thickness of said heat-insulative layer; and said inorganic-system coated-film layer comprising an inorganic compound.

The heat-insulation coating film comprises a heat-insulative layer formed on a surface of the wall face, and an inorganic-system coated-film layer formed on a surface of the heat-insulative layer. The heat-insulative layer includes a resin, and first hollow particles. The first hollow particles are buried inside the resin. An average particle diameter of the first hollow particles is smaller than a thickness of the heat-insulative layer. Since the heat-insulation coating film is provided with a high porosity, and since it exhibits a high heat-insulating property, it can enhance the combustion chamber in the heat-insulating property and can contribute to upgrading the mileage of the engine. Note herein that the "average particle diameter" of the first hollow particles refers to a simple average of their particle diameters in an electron microscope observation.

Since the inorganic-system coated-film layer comprises an inorganic compound, its heat resistance is high. Coating a surface of the heat-insulative layer by the inorganic-system coated-film layer makes it possible to relieve heats being transmitted from the combustion chamber to the heat-insulative layer.

Moreover, when increasing a blending amount of the hollow particles included in the heat-insulative layer, such a fear might possibly arise that cracks occur in the heat-insulative layer. However, even if cracks should have occurred in the heat-insulative layer, coating a surface of the heat-insulative layer by the inorganic-system coated-film layer comprising an inorganic compound makes it possible to maintain the heat-insulative layer. Accordingly, it is possible to prevent the heat-insulating property and coated-film strength of the heat-insulative layer from declining.

In the engine, when a frame-sprayed ceramic film is coated on a top face, one of faces of the piston, which corresponds to the "wall face disposed face-to-face to the combustion chamber," improving the surface roughness of the frame-sprayed ceramic film has limitations. When the frame-sprayed ceramic film is viewed microscopically, a large number of microscopic protrusions are formed on one of the opposite surfaces of the frame-sprayed film disposed face-to-face to the combustion chamber. Such protrusions make heat spots and also become a cause of accidentally provoking the combustion stroke in the engine, so that such a fear might possibly arise that a probability of the occurrence of knocking augments in the engine. In view of this, in accordance with the present invention, the heat-insulation coating film is provided with high superficial flatness/smoothness. Besides, coating the heat-insulative layer by the inorganic-system coated-film layer makes it possible to further upgrade the heat-insulating property of the heat-insulation coating film, and thereby the antiknock property of the engine enhances.

In accordance with the engine directed to the present invention, the heat-insulation coating film comprises the heat-insulative layer in which hollow particles are buried inside a resin, and the inorganic-system coated-film layer coating a surface of the heat-insulative layer. Since the heat-insulative layer includes, along with the resin, a plurality of first hollow particles which are buried inside the resin and whose average particle diameter is smaller than a thickness of the heat-insulative layer, it is possible to expect composite actions by and between the resin and the first hollow particles. That is, since the first hollow particles have nanometer sizes, they possess a property of being less likely to be broken down. When a surface of the heat-insulation coating film receives pressures within the combustion chamber in the course of the explosion stroke, it is possible to expect combined actions between the resin and the hollow particles. Thus, while keeping the strength of the heat-insulation coating film, it is possible to relieve pressures, which the resin receives, by slight elastic deformations of the first hollow particles. Consequently, fissures become less likely to occur in the resin in the heat-insulative layer. Note that, in accordance with testing examples conducted by the present inventors, fissures were likely to occur in heat-insulative layers when the heat-insulative layers were formed of the resin alone, namely, when they did not contain any first hollow particles.

In addition, in accordance with the present invention, a surface of the heat-insulative layer is coated by the inorganic-system coated-film layer. The coating by the inorganic-system coated-film layer imparts further heat resistance to the heat-insulative layer, and thereby makes it possible to prevent the heat-insulating property and coated-film strength thereof from declining, even if cracks should have occurred in the heat-insulative layer.

(2) In the engine directed to the present invention, it is preferable that the average particle diameter of the first hollow particles can be 500 nm or less. Thus, it is possible to make a surface of the heat-insulative layer flatter and smoother.

(3) In the engine directed to the present invention, it is preferable that the thickness of the inorganic-system coated-film layer can be from 10 μm to 300 μm. The thicker the organic-system coated-film layer is, the less likely high temperatures within the combustion chamber become to be transmitted to the heat-insulative layer through the inorganic-system coated-film layer. Consequently, the thicker the inorganic-system coated-film layer is, the more the heat resistance of the heat-insulation coating film upgrades. When the thickness of the inorganic-system coated-film layer is from 10 μm to 300 μm, the film formability of the inorganic-system coated-film layer can be secured while maintaining the heat-resistance upgrading effect resulting from it high.

(4) In the engine directed to the present invention, it is preferable that the inorganic compound constituting the inorganic-system coated-film layer can comprise one or more members selected from the group consisting of silica, zirconia, alumina, and ceria. The inorganic-system coated-film layer constituted of one of these materials excels in the heat resistance.

(5) In the engine directed to the present invention, it is preferable that the inorganic-system coated-film layer can comprise: the inorganic compound; and second hollow particles buried inside the inorganic-system coated-film layer, and exhibiting an average particle diameter being smaller than a thickness of the inorganic-system coated-film layer. If such is the case, not only the heat-insulating property of the heat-insulative layer but also that of the inorganic-system coated-film layer enhance, so that the heat-insulating effect of the entire heat-insulation coating film upgrades. It is preferable that the second hollow particles can be hollow particles whose average particle diameter is 100 μm or less.

(6) In the engine directed to the present invention, it is preferable that an average particle diameter of the second hollow particles included in an outermost superficial-layer section in the inorganic-system coated-film layer can be smaller than another average particle diameter of the second hollow particles included in an interior section in the inorganic-system coated-film layer disposed on a more inner side than is the outermost superficial-layer section therein in a thickness-wise direction thereof. Thus, it is possible to further upgrade the superficial flatness/smoothness of the inorganic-system coated-film layer.

(7) In the engine directed to the present invention, it is preferable that the average particle diameter of the second hollow particles included in the outermost superficial-layer section of the inorganic-system coated-film layer can be 500 nm or less. Thus, it is possible to further upgrade the superficial flatness/smoothness of the inorganic-system coated-film layer. Note herein that the "average particle diameter" of the second hollow particles refers to a simple average of their particle diameters in an electron microscope observation.

(8) In the engine directed to the present invention, it is preferable that the thickness of the heat-insulative layer can be from 10 μm to 2,000 μm; and the average particle diameter of the first hollow particles can be from 10 nm to 500 nm. Thus, it is possible to enhance the dispersibility upon dispersing the first hollow particles inside the heat-insulation coating film, and thereby it is possible to efficiently bury the first hollow particles inside the resin within the heat-insulation coating film.

(9) In the engine directed to the present invention, it is preferable that the heat-insulative layer can exhibit a porosity of from 5% or more to 90% or less when an apparent volume of the heat-insulative layer is taken as 100%. Thus, the heat-insulating effect of the heat-insulative layer further upgrades.

(10) In the engine directed to the present invention, it is preferable that a surface roughness of the wall face after being coated by the heat-insulation coating film can be smaller than another surface roughness of the wall face before being coated by the heat-insulation coating film. Protrusions formed resulting from the surface roughness of the wall face make heat spots and also become a cause of accidentally provoking the combustion stroke in the engine, so that such a fear might possibly arise that a probability of the occurrence of knocking augments in the engine. Hence, making a surface roughness of the wall face after coating the heat-insulation coating film smaller than another surface roughness of the wall face before coating the heat-insulation coating film can result in providing the heat-insulation coating film with high superficial flatness/smoothness, and thereby the antiknock property of the engine enhances.

(11) A piston directed to the present invention is a piston fitted into a bore to be capable of reciprocating therein so as to form a combustion chamber therein;

said piston having wall faces, one of the wall faces disposed face-to-face to said combustion chamber and coated by a heat-insulation coating film;

said heat-insulation coating film comprising: a heat-insulative layer formed on a surface of said wall face; and an inorganic-system coated-film layer formed on a surface of the heat-insulative layer;

said heat-insulative layer comprising: a resin; and first hollow particles buried inside the resin and exhibiting an average particle diameter being smaller than a thickness of said heat-insulative layer; and said inorganic-system coated-film layer comprising an inorganic compound.

The heat-insulation coating film comprises a heat-insulative layer formed on a surface of the wall face, and an inorganic-system coated-film layer formed on a surface of the heat-insulative layer. The heat-insulative layer includes a resin, and first hollow particles buried inside the resin and exhibiting an average particle diameter that is smaller than a thickness of the heat-insulative layer. The heat-insulation coating film is provided with a high porosity, so that it exhibits a high heat-insulating property. Consequently, it is possible to enhance the combustion chamber in the heat-insulating property, and thereby it is possible to contribute to upgrading engines in the mileage.

The inorganic-system coated-film layer comprises an inorganic compound. Consequently, its heat resistance is high. Coating a surface of the heat-insulative layer by the inorganic-system coated-film layer makes it possible to relieve heats being transmitted from the combustion chamber to the heat-insulative layer.

Moreover, when increasing a blending amount of the first hollow particles included in the heat-insulative layer, such a fear might possibly arise that cracks occur therein. However, even if cracks should have occurred in the heat-insulative layer, coating a surface of the heat-insulative layer by the inorganic-system coated-film layer comprising an inorganic compound makes it possible to maintain the heat-insulative layer. Accordingly, it is possible to prevent the heat-insulating property and coated-film strength of the heat-insulative layer from declining.

(12) In the piston directed to the present invention, it is preferable that a surface roughness of the wall face after being coated by the heat-insulation coating film, can be smaller than another surface roughness of the wall face before being coated by the heat-insulation coating film. Thus, it is possible for the heat-insulation coating film to be provided with high superficial flatness/smoothness, and thereby engines' antiknock property enhances.

Effect of the Invention

In accordance with the present invention, since the wall face disposed face-to-face to the combustion chamber is coated by the heat-insulation coating film provided with higher heat-insulating property and higher superficial flatness/smoothness, it is possible to enhance the combustion chamber in the heat-insulating property, and thereby it is possible to contribute to upgrading the mileage of the engine. In addition, since it is possible to enhance one of the pistons in the superficial flatness/smoothness on the top-face side, it is possible to inhibit the engine from knocking.

In accordance with the present invention, the heat-insulation coating film comprises the heat-insulative layer, and the inorganic-system coated-film layer coating a surface of the heat-insulative layer. Consequently, it is possible to relieve heats being transmitted from the combustion chamber to the heat-insulative layer. Moreover, even if cracks should have occurred in the heat-insulative layer, it is possible to maintain the heat-insulative layer by coating the inorganic-system coated-film layer including a coated-film-shaped inorganic compound on the heat-insulative layer. Accordingly, it is possible to prevent the heat-insulating property and coated-film strength of the heat-insulative layer from declining. Hence, it is possible for the present heat-insulation coating film to cope with engines with higher compression ratio.

In accordance with the present invention, since it is possible to enhance the heat-insulating property of the combustion chamber in the engine as described above, the thermal efficiency upgrades at the time of cold starting the engine, and thereby the engine upgrades in the mileage. In general, since the vaporization of fuel is poor at the time of cold starting an engine, more fuel (gasoline, and the like) than required ordinarily has been fed into the combustion chamber. However, coating a wall face disposed face-to-face to the combustion chamber by the heat-insulation coating film, like the present invention, makes it possible to effectively subject the combustion chamber in the engine to heat insulation, so that the vaporization of fuel is improved, and thereby the fuel combustion upgrades. In particular, in hybrid vehicles having been increasing recent years, or in vehicles provided with an idling stop function, it is often the case that the engine is not warmed sufficiently because the engine is running intermittently. On such occasions, the heat-insulation coating film directed to the present invention demonstrates its advantages, and thereby it is likely to maintain the combustion chamber in the engine at high temperatures. Moreover, since combustion heats produced in the combustion chamber become less likely to escape off to the piston, the cylinder block, the cylinder head, and so on, so that the combustion temperature in the combustion chamber rises, and thereby it is also possible to expect an advantage of eventually reducing hydrocarbons (or HC) included in exhaust gases.

MODES FOR CARRYING OUT THE INVENTION

Figure 1:
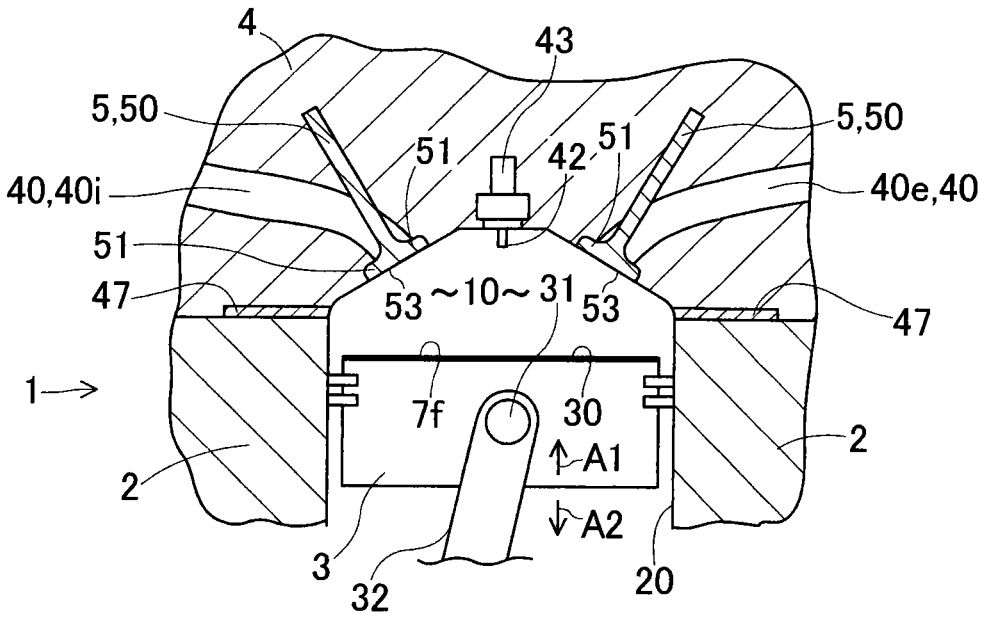
FIG. 1 is directed to First Embodiment Mode, and is a cross-sectional diagram schematically illustrating the vicinity of a combustion chamber in an engine.

An engine according to the present invention comprises one or more members selected from the group consisting of a piston, a cylinder head and a valve, the one or more members having a wall face disposed face-to-face to a combustion chamber in the engine; and including a heat-insulation coating film formed on the wall face. The heat-insulation coating film is composed of a heat-insulative layer coating a surface of the wall face, and an inorganic-system coated-film layer formed on a surface of the heat-insulative layer.

The heat-insulative layer comprises a resin, and first hollow particles. The first hollow particles are buried in the resin. The heat-insulative layer is coated by the inorganic-system coated-film layer having high heat resistance, and is thereby relieved from the influence of heats that it receives from the combustion chamber. Besides, even if cracks should have occurred in the heat-insulative layer, since a surface of the heat-insulative layer is coated by the inorganic-system coated-film layer, it is possible to maintain the heat-insulative layer, so that it is possible to prevent the heat-insulating property and strength from declining. Thus, the engine upgrades in the thermal efficiency, and thereby a vehicle upgrades in the mileage.

The heat-insulative layer is constituted of a resin, and first hollow particles. As a quality of material for the resin, those having adhesiveness, heat resistance, chemical resistance and strength are preferable.

The resin can be at least one member selected from the group consisting of epoxy resins, amino resins, polyaminoamide resins, phenolic resins, xylene resins, furan resins, silicone resins, polyether imide, polyether sulfone, polyether ketone, polyether ether ketone, polyamide-imide, polybenzimidazole, thermoplastic polyimide, and non-thermoplastic polyimide. When being such a resin, it is possible to expect actions directed to the present invention effectively.

A resin whose heat-resistant temperature and thermal-decomposition temperature are higher is preferable. Moreover, taking the heat resistance and thermal-decomposition temperature into consideration, epoxy resins, silicone resins, polyether imide, polyether sulfone, polyether ketone, polyether ether ketone, and polyamide-imide are preferable. When being used in much higher temperature environments, polybenzimidazole, thermoplastic polyimide, and non-thermoplastic polyimide are more preferable. In addition, the resin can preferably be thermoplastic polyimide, or non-thermoplastic polyimide, which is obtainable from pyromellitic dianhydride or biphenyltetracarboxylic dianhydride excelling in the heat resistance. Using one of these resins as a binder to blend nanometer-size (or less-than-one-micrometer) first hollow particles therein enhances porosity in the heat-insulation coating film, and thereby it is possible to secure heat-insulating property for the heat-insulation coating film.

The resin can also be an amino resin, a polyaminoamide resin, a phenolic resin, a xylene resin, or a furan resin, and the like. Moreover, taking the heat resistance and thermal-decomposition temperature into consideration, epoxy resins, silicone resins, polyether imide, polyether sulfone, polyether ketone, polyether ether ketone, and polyamide-imide are preferable. When being used in much higher temperature environments, polybenzimidazole, thermoplastic polyimide, and non-thermoplastic polyimide are more preferable. In addition, the resin can preferably be thermoplastic polyimide, or non-thermoplastic polyimide, which is obtainable from pyromellitic dianhydride or biphenyltetracarboxylic dianhydride excelling in the heat resistance. Using one of these resins as a binder to blend first hollow particles therein enhances porosity in the heat-insulation coating film, and thereby it is possible to secure heat-insulating property for the heat-insulation coating film.

The resin can also include an inorganic material (such as alumina, titania or zirconia, for instance). The inorganic material can even have a powdery particulate shape, or a fibrous shape. As for a size of the inorganic material, the inorganic material can preferably exhibit a particle diameter being substantially equivalent to those of the first hollow particles, or another particle diameter being smaller than those of the first hollow particles.

When an apparent volume of the heat-insulative layer is taken as 100%, a porosity in the heat-insulative layer can preferably be from 5 to 90% by volumetric ratio. In particular, from 10 to 85%, or from 15 to 80%, can be exemplified. The porosity corresponds to a blending amount of the first hollow particles, and influences the heat-insulating property of the heat-insulative layer. When the blending amount of the first hollow particles becomes greater, the porosity becomes higher, so that the heat-insulating property of the heat-insulative layer becomes higher. Note herein that, when the porosity is low excessively, the heat-insulating property of the heat-insulative layer declines. When the porosity is high excessively, a proportion of the first hollow particles becomes excessive with respect to the resin, the resulting binder for binding the first hollow particles together has come to be insufficient, and thereby such a fear might possibly arise that the film formability of the heat-insulative layer is impaired, or that the strength of the heat-insulative layer declines.

As for a quality of material for the first hollow particles, ceramic-system, and organic-system materials are preferable. In particular, silica ($SiO_2$), alumina ($Al_2O_3$), zirconia ($ZrO_2$) and titania ($TiO_2$), which excel in the heat resistance, are more preferable. Depending on cases, the quality of material for the first hollow particles can also be a resin, or can even be a metal.

An average particle diameter of the first hollow particles is smaller than a thickness of the heat-insulative layer. Consequently, a surface of the heat-insulative layer is flattened smoothed, so that dents being able to turn into heat spots become less, and thereby the occurrence of knocking can be reduced. It is allowable that many of the first hollow particles included in the heat-insulative layer can have a particle diameter being smaller than the heat-insulative layer's thickness. When all of the first hollow particles included in the heat-insulative layer is taken as 100%, 50% or more of them, furthermore, 70% or more, 90% or more or 95% or more of them, can possess a particle diameter being smaller than the heat-insulative layer's thickness. Thus, the superficial flatness/smoothness of the heat-insulative layer upgrades.

The average particle diameter of the first hollow particles can be 500 nm or less, or moreover from 10 nm to 500 nm. It is preferable to set the average particle diameter at from 20 nm to 300 nm, or from 30 nm to 150 nm. Since a surface of the heat-insulative layer is coated by the inorganic-system coated-film layer, such a fear might possibly arise extremely less that the first follow particles constituting the heat-insulative layer come to drop off. Even if the nanometer-size first hollow particles should have dropped off from the heat-insulative layer and inorganic-system coated-film layer, in order to suppress any influences to a skirt of the piston, a wall surface of the cylinder bore, and so on, it is preferable that the average particle diameter of the first hollow particles can be smaller than a thickness of an oil film formed between the piston's skirt and the cylinder bore's wall face.

As for a thickness of the first hollow particles' shell, the following can be exemplified: from 0.5 nm to 50 nm, from 1 nm to 30 nm, or preferably from 5 nm to 15 nm, although the shell's thickness also depends on the average particle diameter of the first hollow particles. As for a configuration of the first hollow particles, the first hollow particles can have a spherical shape, a pseud-spherical shape, a pseud-oval shape, or a pseud-polygonal shape (including pseud-cubic configurations and pseud-rectangular parallelepiped configurations), and the like. A surface of the shell forming the first hollow particles can also allowably be flat and smooth, or can even permissively have minute irregularities.

The first hollow particles can be nanometer-size hollow particles whose average particle diameter is less than 1 μm. The thickness of a shell can be made thinner to be able to secure heat-insulating property when nanometer-size hollow particles are used for the heat-insulative layer than when hollow particles having such a large size as from a few to hundreds nanometers. The nanometer-size hollow particles are less likely to appear in the neighborhood of a surface of the heat-insulative layer, thereby enhancing the flatness/smoothness of a surface of the inorganic-system coated-film layer coating the heat-insulative layer's surface, namely, the flatness/smoothness of a surface of the heat-insulation coating film.

The first hollow particles having a very minute average particle diameter, like 500 nm or less (from 10 to 500 nm approximately, for instance), make it possible to make their own filling amount into the resin (or a binder) greater. The first hollow particles make it possible to disperse minute vacant holes within the resin. Thus, even when the heat-insulative layer is thin, it is feasible to secure the heat-insulating property of the heat-insulative layer. Moreover, making the first hollow particles have an average particle diameter at the nanometer level results in making irregularities, which arise from the first hollow particles in a surface of the heat-insulation coating film, smaller extremely, so that a levelling action of the resin, which turns into a binder, enables a surface of the heat-insulation coating film to be flattened and smoothed, and thereby it is possible to enhance knock limits in the engine.

On the contrary, the first hollow particles, which are on the order of micrometer to have an average particle diameter of 1 μm or more, can enhance the porosity of the heat-insulative layer. Thus, they can further upgrade the heat-insulation performance of the heat-insulation coating film. In this instance as well, it is necessary for the first hollow particles to be smaller than a thickness of the heat-insulative layer. That is, it is allowable that an average particle diameter of the first hollow particles can be smaller than the heat-insulative layer's thickness. It is permissible that an average particle diameter of the first hollow particles on the order of micrometer can be from 1 μm or more to 100 μm or less; and moreover it is preferable that the average particle diameter can be from 1 μm or more to 50 μm or less.

A thickness of the heat-insulative layer can preferably be from 10 μm to 2,000 μm, or from 20 μm to 1,000 μm, taking securing therefor heat resistance, adhesiveness, porosity, and so on, into consideration. It is also possible to set the thickness at from 50 μm to 700 μm, or alternatively at from 100 μm to 700 μm. As for an upper limit value of the heat-insulative layer's thickness, 2,000 μm, 1,000 μm, 800 μm, 500 μm, or 300 μm can be exemplified. As for a lower limit value of the heat-insulative layer's thickness, 20 μm, 30 μm, or 40 μm can be exemplified. When the heat-insulative layer's thickness and the first hollow particles' average particle diameter are measured in the same units one another and a ratio, (Heat-insulative layer's Thickness)/(First Hollow Particles' Average Particle Diameter), is labeled as "α," it is possible to exemplify "α" falling within a range of from 200,000 to 20, within a range of from 50,000 to 20, or within a range of from 30,000 to 100. In this instance, it is possible to enhance the dispersibility of the first hollow particles in the heat-insulative layer, and thereby it is advantageous to enhance the heat-insulating property of the heat-insulative layer, along with reducing uneven heat insulation.

The heat-insulative layer of the heat-insulation coating film can include, in addition to the resin and first hollow particles, an additive agent, if needed. As for the additive agent, the following can be given, if needed: a dispersing agent for enhancing the dispersibility of the first hollow particles; a silane-coupling agent for upgrading the adhesion property and affinity of the first hollow particles to blended powders, or for supplementing the upgrade of the adhesion property; a levelling agent for adjusting surface tension; a surfactant; or a thickening agent for adjusting thixotropic characteristic; and the like.

The inorganic-system coated-film layer coating a surface of the heat-insulative layer comprises an inorganic-system material mainly, or includes an inorganic compound. It is allowable for the inorganic compound constituting the inorganic-system coated-film layer to comprise at least one member selected from the group consisting of silica, zirconia, alumina, and ceria. Of these, it is permissible therefor to comprise silica.

It is allowable that a thickness of the inorganic-system coated-film layer can be from 10 to 300 μm; and moreover it is preferable that the thickness can be from 30 to 200 μm, or it is desirable that the thickness can be from 50 to 150 μm. Thus, high temperatures in the combustion chamber are less likely to be conveyed to the heat-insulative layer through the thin inorganic-system coated-film layer, so that the film formability can be maintained. Thus, the heat-insulative layer is not exposed to the high temperatures, and thereby it is possible to prevent the resin in the heat-insulative layer from degrading. Coating a surface of the heat-insulative layer with the inorganic-system coated-film layer results in making the heat-insulative layer endurable to temperatures up to 2,000° C. or more approximately.

The inorganic-system coated-film layer can include, in addition to the inorganic compound, second hollow particles, too. It is allowable that the second hollow particles can be hollow particles whose average particle diameter is smaller than a thickness of the inorganic-system coated-film layer. When including the second hollow particles in the inorganic-system coated-film layer, a ceramic-system or organic-system material is preferable as a quality of material for the second hollow particles, in the same manner as that for the first hollow particles included in the heat-insulative layer. In particular, silica ($SiO_2$), alumina ($Al_2O_3$), zirconia ($ZrO_2$) and titania ($TiO_2$), which excel in the heat resistance, are more preferable. Depending on cases, the quality of material for the second hollow particles can also be a resin, or can even be a metal. The quality of material for the second hollow particles can much more preferably be a ceramic-system material, from the viewpoint of the heat resistance.

The second hollow particles, which might possibly be included in the inorganic-system coated-film layer, exhibit an average particle diameter being smaller than a thickness of the inorganic-system coated-film layer. It is preferable that the average particle diameter of the second hollow particles can be 500 μm or less. And moreover, the average particle diameter can allowably be 100 μm or less, or can permissively be from 10 nm to 50 μm. The average particle diameter can more preferably be from 10 nm to 500 nm, from 20 nm to 300 nm, or from 30 nm to 150 nm. If such is the case, it is possible to retain the flatness/smoothness of the inorganic-system coated-film layer, and thereby it is possible to enhance the antiknock property.

When including the second hollow particles in the inorganic-system coated-film layer, the average particle diameter of the second hollow particles can even be the same as the average particle diameter of the first hollow particles included in the heat-insulative layer, can even be smaller than that of the first hollow particles, or can even be larger than that of the first hollow particles. Yet, in any of the cases, the average particle diameter of the second hollow particles can be smaller than a thickness of the inorganic-system coated-film layer. Preferably, the second hollow particles' average particle diameter can be the same as the first hollow particles' average particle diameter, or can be smaller than that.

When all of the second hollow particles included in the inorganic-system coated-film layer are taken as 100%, it is preferable that 50% or more of them; and moreover 70% or more thereof, 90% or more thereof, or 95% or more thereof can exhibit a particle diameter being smaller than a thickness of the inorganic-system coated-film layer. Thus, the superficial flatness/smoothness of the heat-insulation coating film upgrades.

It is preferable that an average particle diameter of the second hollow particles included in an outermost superficial-layer section in the inorganic-system coated-film layer can be smaller than another average particle diameter of the second hollow particles included in an interior section in the inorganic-system coated-film layer disposed on a more inner side than is the outermost superficial-layer section therein in a thickness-wise direction thereof. Thus, while retaining the flatness/smoothness of the inorganic-system coated-film layer, it is possible to enhance the heat-insulating effect thereof.

An upper limit of the average particle diameter of the second hollow particles included in the outermost superficial-layer section in the inorganic-system coated-film layer can be 100 μm; and moreover the average particle diameter can be 50 μm, 500 nm, 300 nm, or 150 nm. A lower limit of the average particle diameter of the second hollow particles included in the outermost superficial-layer section in the inorganic-system coated-film layer can be 10 nm, 20 nm, or 30 nm. Thus, it is possible to retain the flatness/smoothness of the inorganic-system coated-film layer.

An upper limit of the other average particle diameter of the second hollow particles included in the interior section in the inorganic-system coated-film layer can be 500 μm; and moreover the other average particle diameter can be 100 μm, 50 μm, 500 nm, 300 nm, or 150 nm. A lower limit of the other average particle diameter of the second hollow particles included in the interior section in the inorganic-system coated-film layer can be 10 nm, 20 nm, or 30 nm. Thus, it is possible to retain the flatness/smoothness of the inorganic-system coated-film layer.

When employing a low thermal-conductivity member as shown in above-mentioned Patent Literature No. 1, a thickness in units of millimeter is needed structurally. In this instance, a weight increment in piston is inevitable; but the weight increment is not preferable, because it hampers the operations of the piston moving at high speeds and then becomes an obstacle to the upgrade of mileage. On the contrary, as shown in Table 1 below, since the heat-insulative layer directed to the present invention includes a resin, such an advantage is obtainable that it has a specific gravity being lighter than that of aluminum alloy. Note herein that a heat-insulating property obtainable by titanium, say, having a thickness of 7 mm, corresponds to a heat-insulating property obtainable by a zirconia flame-sprayed film (according to Patent Literature Nos. 2 and 3) having a thickness of 1.65 millimeter. On the other hand, the heat-insulating property obtainable by titanium corresponds to a heat-insulating property obtainable by the heat-insulation coating film directed to the present invention and having only such a thin thickness as from 0.012 to 0.083 mm only. Thus, in the heat-insulation coating film directed to the present invention, since it is possible to form it as a thinned film while securing the heat-insulating property, such another advantage is obtainable that, even when the heat-insulation coating film is formed on the top surface of a piston, it does not have any influences on the operations of the piston, because the piston is increased in the weight very slightly while it is enhanced in the heat-insulating property on the top-face side.

TABLE 1

| | Specific Gravity | Thermal Conductivity (W/mK) | Required Film Thickness (mm) |
|---|---|---|---|
| Aluminum (Piston's Parent Material) | 2.7 | 130 | |
| Titanium (Patent Literature No. 1) | 4.5 | 17 | 7 (Hypothetical Value) |
| Frame - sprayed Zircona (Patent Literature Nos. 2 and 3) | 6 | 4 | 1.65 |
| Heat-insulative layer Alone | 1.0-1.8 | 0.05-0.22 | 0.021-0.091 |
| Heat-insulative layer + Inorganic-system Coated-film Layer | 1.0-1.8 | 0.03-0.20 | 0.012-0.083 |

Moreover, as set forth in Patent Literature No. 4, hollow particles with from a few micrometers to hundreds micrometers have been blended in ordinary heat-insulative paint. However, when the hollow particles having such a size appear in the neighborhood of a surface, differences between the irregularities in the surface become larger. Moreover, upon employing the ordinary heat-insulative paint for engine, the protrusions make heat spots, so that such a fear might possibly arise that knocking occurs therein. In addition, when the hollow particles have dropped off from its binder due to certain causes, the hollow particles with from a few micrometers to hundreds micrometers are larger than the thickness of oil films (e.g., from about 0.5 to 1 μm) on the sliding parts of the engine, and they are harder than materials for piston and cylinder. Consequently, the hollow particles have worn down pistons and cylinders.

In Patent Literature Nos. 2, 3 and 5, a face has been roughened after the film-forming treatment than before the film-forming treatment. Thus, when the film-forming treatments are applied to the top surface of a piston, the resulting protrusions with fine roughness make heat spots, and thereby become the cause of knocking.

On the contrary, the heat-insulation coating film directed to the present invention comprises the heat-insulative layer in which a plurality of the hollow particles are buried and whose surface is provided with the inorganic-system coated-film layer. Consequently, it is possible for the heat-insulation coating film to exhibit superficial flatness/smoothness while securing a high porosity.

In addition, a surface of the heat-insulative layer is coated by the inorganic-system coated-film layer. Since the inorganic-system coated-film layer comprises an inorganic compound, it has high heat resistance. Coating the heat-insulative layer's surface by the inorganic-system coated-film layer makes it possible to relieve heats being transmitted from the combustion chamber to the heat-insulative layer.

Moreover, when increasing a blending amount of the first hollow particles included in the heat-insulative layer, such a fear might possibly arise that cracks occur in the heat-insulative layer. However, even if cracks should have occurred in the heat-insulative layer, coating a surface of the heat-insulative layer by the inorganic-system coated-film layer makes it possible to maintain the heat-insulative layer. Accordingly, it is possible to prevent the heat-insulating property and coated-film strength of the heat-insulative layer from declining.

Even if cracks should have occurred, it is possible to relive thermal contractions of the heat-insulative layer resulting from the cracks. Moreover, fine clearances might possibly be formed between the heat-insulative layer and the inorganic-system coated-film layer. It is also feasible to enhance heat-insulating property by the resulting clearances. In addition, it is possible to make a surface roughness of the heat-insulative layer much flatter and smoother. Consequently, it is possible to further materialize the superficial flattening and smoothing when forming the inorganic-system coated-film layer on a surface of the heat-insulative layer, rather than when forming the heat-insulative layer alone on one of the wall faces. Hence, heat spots become less likely to be formed on a wall face of the combustion chamber, and thereby it is possible to effectively inhibit knocking from occurring.

Moreover, since it is possible to blend the first hollow particles in the heat-insulative layer in a greater amount, the heat-insulating effect of the heat-insulative layer enhances more, and it is possible to make the specific gravity of the heat-insulative layer smaller. Therefore, it is possible to enhance the combustion chamber in the heat-insulating property. When the heat-insulation coating film directed to the present invention is formed on one of the wall faces (i.e., the wall face disposed face-to-face to the combustion chamber), it is possible to complete the film formation with ease on the wall face. In addition, when the first hollow particles are nanometer-size hollow particles whose average particle diameter is less than 1 μm on the order of nanometer, mixing the nanometer-size hollow particles into the resin leads to making a post-coating surface roughness of the heat-insulation coating film smaller than a prior-to-coating surface roughness of a piston, without imparting the leveling action of the resulting paint. As a result, a specific surface area of the piston becomes smaller, so that the transfer of heats from the piston is inhibited, and thereby it becomes feasible to upgrade the piston more in the heat-insulation performance.

It is preferable that the wall face's surface roughness after being coated by the heat-insulation coating film can be smaller than the surface roughness before being coated by it. Taking knock limits into consideration, a surface roughness of the het-insulation coating film, namely a surface roughness of the inorganic-system coated-film layer can preferably be 10.0 or less, or 7.0 or less, expressed in "Ra." The surface roughness can more preferably be 5.0 or less, or 3.0 or less. Moreover, the surface roughness can much more preferably be 2.0 or less. In addition, even if the first hollow particles should have dropped off from the resin, since they have such a size being smaller than the above-described oil-film thickness, they are covered with an oil film, and thereby such a fear is suppressed that they might possibly damage the piston in the skirt, or the cylinder block in the bore's wall face.

When forming the heat-insulation coating film directed to the present invention, the heat-insulative layer is first formed on a surface of one of the wall faces. In order to form the heat-insulative layer, the resin is made to exhibit a lower viscosity by dissolving it in a solvent, and so on, and then a paint is formed by mixing the first hollow particles with the resulting mixture to disperse them therein. Upon doing the dispersing operation, the following can be available; an ultrasonic disperser, a wet-type jet mill, a homogenizer, a triple roller, or a high-speed stirrer, and the like. The heat-insulation coating film can be formed by applying the resultant paint onto one of the wall faces forming a combustion chamber to form a paint film thereon and then baking the resulting paint film thereon. As for a form of the application operation, the following publicly-known forms of painting operation can be given; painting by spray, painting by brush, painting by roller, roll-coater painting, electrostatic painting, immersion painting, screen printing, or pad printing, and so forth.

After doing the painting operation, the paint film is baked by keeping it being heated, and thereby it is possible to turn the paint film into the heat-insulative layer. As for a baking temperature, it is possible to set it up in compliance with a material quality of the resin, and the following can be given: from 130 to 220° C., from 150 to 200° C., or from 170 to 190° C. As for a baking time, the following can be exemplified: from 0.5 to 5 hours, from 1 to 3 hours, or from 1.5 to 2 hours. It is preferable to carry out a preliminary treatment, such as shot blasting, etching or a chemical conversion treatment, to one of the wall faces of the piston, etc., before subjecting it to the formation of the heat-insulation coating film.

Next, the inorganic-system coated-film layer comprising an inorganic compound is formed on a surface of the heat-insulative layer. In order to form the inorganic-system coated-film layer, it is possible to employ publicly-known techniques, for instance.

Moreover, it is also allowable to form the heat-insulation coating film directed to the present invention on the top face of a piston alone; alternatively, it is even possible to form it on one of the cylinder head's wall faces disposed face-to-face to the combustion chamber. In addition, it is also possible to form the heat-insulation coating film directed to the present invention on one of the wall faces of a valve, which opens and closes an intake or exhaust valve bore to form the combustion chamber, too. In this instance as well, it is possible to enhance the combustion chamber in the heat-insulating property. Note that, as for the engine, internal combustion engines, or reciprocating engines, and the like, can be given. As for a fuel employed for the engine, gasoline, light oil, or LPG, and so forth, can be given.

First Embodiment Mode

Figure 2A:
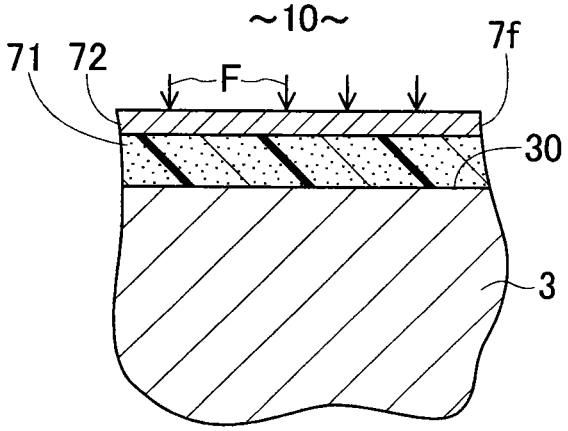
FIG. 2A is directed to First Embodiment Mode, and is a cross-sectional diagram schematically illustrating the vicinity of a heat-insulation coating film formed on the top face of a piston.
Figure 2B:
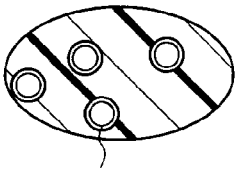
FIG. 2B is directed to First Embodiment Mode, and is a cross-sectional diagram schematically illustrating the interior of a heat-insulative layer in the heat-insulation coating film formed on the top face of the piston.

FIG. 1, FIG. 2A and FIG. 2B illustrate the concepts of First Embodiment Mode schematically. FIG. 1 illustrates a cross section of the vicinity of a combustion chamber 10 of an engine 1. The engine 1 is a piston-type internal combustion engine. FIG. 1, FIG. 2A and FIG. 2B are not more than conceptual diagrams, and accordingly do not prescribe details at all. The engine 1 is provided with: a cylinder block 2 having a bore 20; a piston 3 fitted into the bore 20 to be capable of reciprocating therein in the directions of arrows (A1, A2) so as to form the combustion chamber 10 therein on the side of its top face 30; a cylinder head 4 possessing a valve bore 40 closing the combustion chamber 10 and communicating therewith; and a valve 5 opening and closing the valve bore 40. The valve bore 40 is provided with a valve bore 40*i* for intake and a valve bore 40*e* for exhaust that are able to communicate with the combustion chamber 10. The cylinder head 4 is installed to cover the cylinder block 2 by way of a gasket 47. The cylinder block 2, the cylinder head 4, and the piston 3 are formed of an aluminum alloy for casting, respectively. As for the aluminum alloy, the following are preferable: aluminum-silicon-based alloys, aluminum-silicon-magnesium-based alloys, aluminum-silicon-copper-based alloys, aluminum-silicon-magnesium-copper-based alloys, and aluminum-silicon-magnesium-copper-nickel-based alloys. The aluminum alloys can also have a eutectoid composition, a eutectic composition, or a hypereutectic composition. Depending on cases, at least one of the cylinder block 2, cylinder head 4 and piston 3 can even be formed of a magnesium-alloy-based alloy, or a cast-iron-based alloy (including flaky graphite cast iron or spherical graphite cast iron, for instance).

As illustrated in FIG. 1, FIG. 2A and FIG. 2B, a first heat-insulation coating film 7*f* whose thickness is from 20 to 1,000 μm is coated on the entire area of the top surface 30, one of the wall faces of the piston 3 disposed face-to-face the combustion chamber 10, or almost all the entire area of the top face 30. In this instance, it is preferable to form the first heat-insulation coating film 7*f* on the top face 30 of the piston 3 alone. Note that, taking abrasion, and the like, into consideration, it is not preferable to form it on an outer wall face of the skirt in the piston 3.

The first heat-insulation coating film 7*f* comprises a heat-insulative layer 71 coating the top face 30 of the piston 3, and an inorganic-system coated-film layer 72 coating a surface of the heat-insulative layer 71. The heat-insulative layer 71 includes a resin, and a plurality of nanometer-size hollow particles 70 (i.e., the first nanometer-size hollow particles) buried in the resin. For the nanometer-size hollow particles 70, ceramic balloons, such as silica balloons or alumina balloons, are used. It is possible to set an average particle diameter of the nanometer-size hollow particles 70 at from 10 to 500 nm, or especially at from 30 to 150 nm. However, it shall not be limited to these at all. It is possible to set a range of the nanometer-size hollow particles' particle diameters at less than 1 μm; but it is preferable to set it at from 1 to 500 nm, or from 5 to 300 nm; and it is more preferable to set it at from 30 to 150 nm. It is possible to set a thickness of a shell of the nanometer-size hollow particles 70 at from 1 to 50 nm, or from 5 to 15 nm. The "average particle diameter" refers to a simple average of particle diameters in an electron microscope observation. As to a lower limit of the average particle diameter of the nanometer-size hollow particles 70, it is possible to set it at 8 nm or 9 nm by an electron microscope observation, whereas, as to an upper limit thereof, it is possible to set it at 600 nm or 800 nm.

As for the resin, the following can also be used; amino resins, polyaminoamide resins, phenolic resins, xylene resins, or furan resins, and the like, depending on cases. Moreover, taking the heat resistance and thermal-decomposition temperature into consideration, the following are preferable: epoxy resins, silicone resins, polyether imides, polyether sulfones, polyether ketones, polyether ether ketones, or ployamide-imides. When being used in much higher temperature environments, the following are more preferable: polybenzimidazoles, thermoplastic polyimides, and non-thermoplastic polyimides. In addition, the resin can most preferably be a thermoplastic polyimide, or a non-thermoplastic polyimide, which is obtainable from pyromellitic dianhydride or biphenyltetracarboxylic dianhydride excelling in the heat resistance.

The inorganic-system coated-film layer 72 comprises an inorganic compound. A thickness of the inorganic-system coated-film layer 72 can be from 10 to 300 μm. The inorganic compound can include one or more members selected from the group consisting of silica, alumina, and titania. Among these, silica is preferred.

The first heat-insulation coating film 7*f* is formed on the top face 30, one of the faces of the piston 3 disposed face-to-face to the combustion chamber 10. The heat-insulative layer 71 constituting the lower layer of the first heat-insulation coating film 7*f* contains the nanometer-size hollow particles having such a very minute size as 500 nm or less. The nanometer-size hollow particles having the minute size make it possible to make their own filling amount into the resin (or a binder) greater, and thereby make it possible to disperse minute vacant holes resulting from the nanometer-size hollow particles. Hence, even when the heat-insulative layer 71 is a thin layer, it is possible to secure heat-insulating property for the heat-insulative layer 71 and heat-insulating property for the combustion 10 eventually. A thickness of the heat-insulative layer 71 can be from 10 to 2,000 μm; and moreover it can preferably be from 20 to 1,000 μm, or from 50 to 700 μm, and it can more preferably be from 100 to 500 μm.

A thickness of the inorganic-system coated-film layer 72 can be thinner than the thickness of the heat-insulative layer 71, can preferably be from 10 to 300 μm, and can more preferably be from 50 to 150 μm. Consequently, further heat resistance is imparted to the heat-insulative layer 71 by means of coating the inorganic-system coated-film layer 72; and, even if cracks should have occurred, it is possible to maintain the film formation, so that it is possible to prevent the heat-insulating property and coated-film strength from declining. Moreover, it is possible to make a surface of the heat-insulative layer 71 flatter and smoother, and thereby it is possible to effectively inhibit knocking from occurring.

Consequently, heats in the combustion chamber 10 are inhibited from escaping off to a side of the cylinder block 2 by way of the piston 3, and thereby the heat-insulating property of the combustion chamber 10 enhances. Note that the piston 3 is connected to a connecting rod 32 by way of a connector pin 31. A spark plug 43, which possesses a sparking element 42 disposed face-to-face to the combustion chamber 10, is disposed in the cylinder head 4. Valves 5 are formed of a heat-resistant steel, and comprise a rod-shaped valve stem 50 and a disk-shaped head 51 expanding its diameter diametrically, respectively. The head 51 includes a valve face 53 disposed face-to-face to the combustion chamber 10. A built-up film can also be built up onto the valve face 53. It is possible to form the built-up film of a copper alloy, or an iron alloy.

In accordance with the present embodiment mode, comprising the heat-insulation coating film provided with higher heat-insulating property and higher superficial flatness/smoothness results in making it possible to enhance the heat-insulating property of a combustion chamber, and thereby making it possible to contribute to upgrading the mileage of an engine. Moreover, since it is possible to enhance a piston in the superficial flatness/smoothness on the top-face side, it is possible to inhibit an engine from knocking. The pressure "F" in the combustion chamber 10 in the expansion stroke of the engine 1 acts on the heat-insulation coating film 7*f* (see FIG. 2B). The pressure "F" is believed to be received by the heat-insulation coating film 7*f* in which a plurality of the nanometer-size hollow particles are buried in a dispersed state.

In accordance with the present embodiment mode, since it is possible to enhance the heat-insulating property of the combustion chamber 10 in the engine 1 as described above, the thermal efficiency upgrades at the time of cold starting the engine 1, and thereby the mileage of the engine 1 upgrades. In general, since the vaporization of fuel is poor at the time of cold starting the engine 1, more fuel (gasoline, and the like) than required ordinarily has been fed into the combustion chamber. However, laminating the heat-insulation coating film 7*f* directed to the present embodiment mode on the top face 30 of the piston 3 makes it possible to effectively subject the combustion chamber 10 in the engine 1 to heat insulation, so that the vaporization of fuel is improved, and thereby the fuel combustion upgrades. In particular, in hybrid vehicles having been increasing recent years, or in vehicles provided with an idling stop function, it is of ten the case that the engine 1 is not warmed sufficiently because the engine 1 is running intermittently. On such occasions, the heat-insulation coating film 7*f* directed to the present embodiment mode demonstrates its advantages, and thereby it is likely to maintain the combustion chamber 10 in the engine 1 at high temperatures. Moreover, since combustion heats produced in the combustion chamber 10 become less likely to escape off to the piston 3, the cylinder block 2, the cylinder head 4, and so on, so that the combustion temperature in the combustion chamber rises, and thereby it is also possible to expect an advantage of enabling hydrocarbons (or HC) included in exhaust gases to reduce eventually. Note that a post-coating surface roughness of the heat-insulation coating film 7*f* is smaller than a surface roughness of the top face 30 before coating the heat-insulation coating film 7*f*.

One of processes for forming the heat-insulation coating film 7*f* directed to the present embodiment mode will be hereinafter explained. First of all, the resin is made to exhibit a lower viscosity by dissolving it in a solvent, and then a paint is formed by mixing the nanometer-size hollow particles with the resulting mixture to disperse them therein with a disperser. A paint film is formed by applying such a paint onto the top face of a piston with a spray, and the like. Thereafter, the paint film is baked within an atmosphere in the air at a predetermined temperature (e.g., an arbitrary value within a range of from 120 to 400° C.) for a predetermined time (e.g., an arbitrary value within a range of from 0.5 to 10 hours).

Next, the inorganic-system coated-film layer 72 comprising a metallic compound is formed on a surface of the heat-insulative layer 71. Upon forming the inorganic-system coated-film layer 72 when the metallic compound is silica, an alcohol solution of metallic alkoxysilane, for instance, is applied onto a surface of the heat-insulative layer 71, and is thereafter turned into a coated film by a dealcoholization reaction. A reaction equation of the dealcoholization reaction is expressed by Equation (1) below.

$$\text{—Si—O—R+HO—Si—} \rightarrow \text{—Si—O—Si—+ROH} \quad (1)$$

(In Equation (1), "R" specifies an organic group.)

The inorganic-system coated-film layer 72 can also be formed by another reaction mechanism. Thus, the inorganic-system coated-film layer 72 comprising coated-film-shaped silica, which is joined one after another continuously as a networked shape, is formed, and thereby the heat-insulation coating film 7*f* comprising the heat-insulative layer 71 and inorganic-system coated-film layer 72 is formed.

Second Embodiment Mode

Figure 3A:
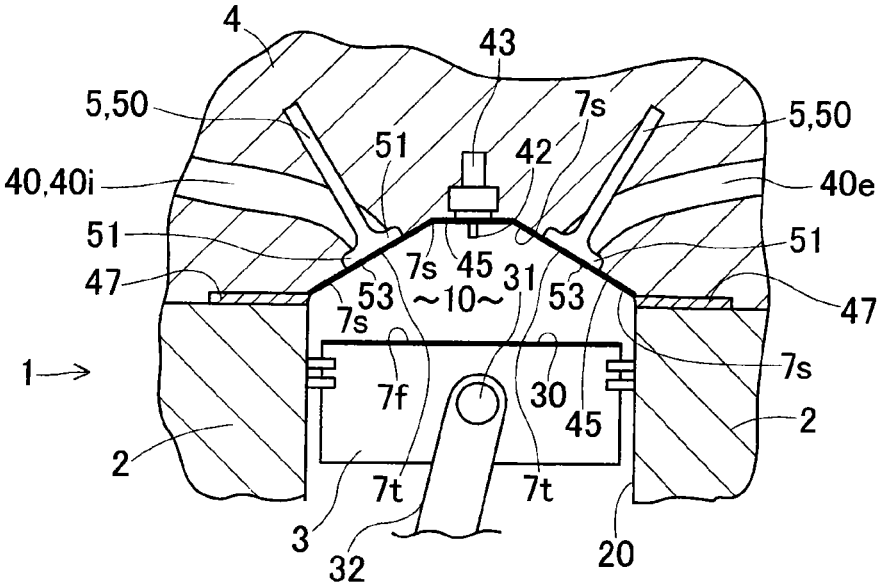
FIG. 3A is directed to Second Embodiment Mode, and is a cross-sectional diagram schematically illustrating the vicinity of a combustion chamber in an engine.
Figure 3B:
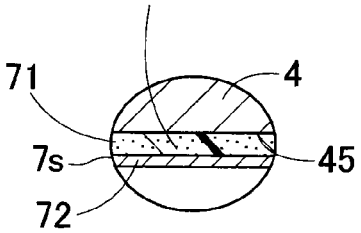
FIG. 3B is directed to Second Embodiment Mode, and is a cross-sectional diagram schematically illustrating the vicinity of a heat-insulation coating film coating a top face disposed face-to-face to the combustion chamber in the engine.
Figure 3C:
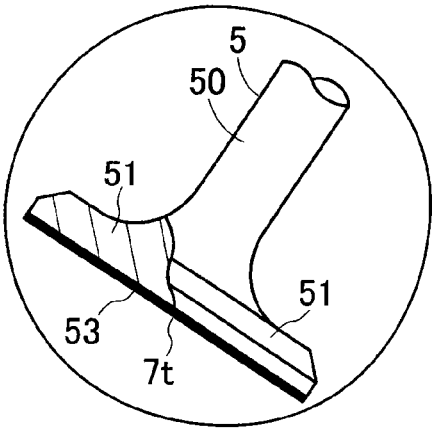
FIG. 3C is directed to Second Embodiment Mode, and is a cross-sectional diagram schematically illustrating the vicinity of a heat-insulation coating film coating a valve face, one of the faces of a valve disposed face-to-face to the combustion chamber in the engine.

FIG. 3A, FIG. 3B and FIG. 3C illustrate Second Embodiment Mode. The present embodiment mode comprises the same constituents as those of First Embodiment Mode basically, and operates and effects advantages in the same manner as it does. FIG. 3A, FIG. 3B, and FIG. 3C illustrate a cross section of the vicinity of a combustion chamber 10 in an engine 1, respectively. A first heat-insulation coating film 7*f* is formed on a top face 30, one of the wall faces of a piston 3 disposed face-to-face to the combustion chamber 10. Moreover, a second heat-insulation coating film 7*s* is formed on a wall face 45, one of the wall faces of a cylinder head 4 disposed face-to-face to the combustion chamber 10. Since the top face 30 and wall face 45 disposed face-to-face to the combustion chamber 10 are coated respectively by the first heat-insulation coating film 7*f* and second heat-insulation coating film 7*s*, the heat-insulating property of the combustion chamber 10 enhances. Depending on cases, it is even permissible to do away with the first heat-insulation coating film 7*f*, as far as the second heat-insulation coating film 7*s* is formed on the wall face 45 of the cylinder head 4. Note that a surface roughness of the wall faces after being coated by the heat-insulation coating films (7*f*, 7*s*) is smaller than another surface roughness of the wall faces before being coated by them.

Third Embodiment Mode

Since the present embodiment mode comprises the same constituents as those of First and Second Embodiment Modes basically, and operates and effects advantages in the same manner as they do, it can be described with reference to FIG. 1 through FIG. 3C. A first heat-insulation coating film 7*f* is formed on a top face 30, one of the wall faces of a piston 3 disposed face-to-face to the combustion chamber 10. Moreover, a second heat-insulation coating film 7*s* is formed on a wall face 45, one of the wall faces of a cylinder head 4 disposed face-to-face to the combustion chamber 10. Besides, a third heat-insulation coating film 7*t* is formed also on a valve face 53, one of the wall faces of valves 5 disposed face-to-face to the combustion chamber 10. Thus, the first heat-insulation coating film 7*f* is formed on the top face 30 disposed face-to-face to the combustion chamber 10; the second heat-insulation coating film 7*s* is formed on the wall face 45, one of the wall faces of the cylinder head 4 disposed face-to-face to the combustion chamber 10; and the third heat-insulation coating film 7*t* is formed on the valve face 53, one of the wall faces of the valves 5 disposed face-to-face to the combustion chamber 10. Consequently, the heat-insulating property of the combustion chamber 10 enhances more. Note that a surface roughness of the coated heat-insulation coating films (7*f*, 7*s* and 7*t*) is smaller than a prior-to-coating surface roughness of the wall faces such as the top face 30, the wall face 45 and the valve face 53.

When a thickness of the first heat-insulation coating film 7*f* is labeled as "$t_1$," a thickness of the second heat-insulation coating film 7*s* is labeled as "$t_2$," and a thickness of the third heat-insulation coating film 7*t* is labeled as "$t_3$," it is possible to set them as follows: "$t_1$" "$t_2$"="$t_3$"; or "$t_1$" "$t_2$" "$t_3$" (note that "$t_1$," "$t_2$" and "$t_3$" are not shown diagrammatically in FIG. 3). Taking inhibiting heats from escaping off from the piston 3 into consideration, it is also allowable to set them as follows: "$t_1$">"$t_2$">"$t_3$"; or "$t_1$">"$t_2$"≈"$t_1$." Taking inhibiting heats from escaping off from the cylinder head 4 into consideration, it is even permissible to set them as follows: "$t_2$">"$t_1$">"$t_3$"; or "$t_2$">"$t_1$"≈"$t_3$." Since a projected area obtained by projecting the valve face 53 of the disk-shaped head 51 in the valve 5 in the perpendicular direction is smaller than another projected area obtained by projecting the top face 30 of the piston 3 in the perpendicular direction, it is also possible to do away with the third heat-insulation coating film 7*t*.

Fourth Embodiment Mode

Since the present embodiment mode comprises the same constituents as those of First through Third Embodiment Modes basically, and operates and effects advantages in the same manner as they do, it can be described with reference to FIG. 1 through FIG. 3C. A first heat-insulation coating film 7*f* is formed on a top face 30, one of the wall faces of a piston 3 disposed face-to-face to the combustion chamber 10, although it is not shown in the drawings. Moreover, a second heat-insulation coating film 7*s* is formed on a wall face 45, one of the wall faces of a cylinder head 4 disposed face-to-face to the combustion chamber 10. Consequently, the heat-insulating property of the combustion chamber 10 enhances.

Fifth Embodiment Mode

Since the present embodiment mode comprises the same constituents as those of First through Fourth Embodiment Modes basically, it can be described with reference to FIG. 1 through FIG. 3C. Hollow particles serving as the second nanometer-size hollow particles are included in an inorganic-system coated-film layer 72, although they are not shown in the drawings. The inorganic-system coated-film layer 72 comprises the hollow particles, and silica (i.e., a binder) serving as a metallic compound. When the entirety of the inorganic-system coated-film layer 72 is taken as 100% by volume, a content of the hollow particles is 35% by volume, and a content of the silica is 65% by volume. A thickness of the inorganic-system coated-film layer 72 is 40 μm.

The hollow particles to be included in the inorganic-system coated-film layer 72 are the same as the nanometer-size hollow particles 70 to be included in the heat-insulative layer 71. That is, the hollow particles to be included in the inorganic-system coated-film layer 72 are ceramic balloons such as silica balloons or alumina balloons. It is possible to set an average particle diameter of the hollow particles at from 10 to 500 nm, or especially at from 30 to 150 nm. However, it shall not be limited to these at all. It is possible to set a thickness of the hollow particles' shell at from 1 to 50 nm, or from 5 to 15 nm. The "average particle diameter" refers to a simple average of particle diameters in an electron microscope observation. As to a lower limit of the hollow particles' average particle diameter, it is possible to set it at 8 nm or 9 nm by an electron microscope observation, whereas, as to an upper limit thereof, it is possible to set it at 600 nm or 800 nm.

In the present embodiment mode, the hollow particles are included not only in the heat-insulative layer 71 but also in the inorganic-system coated-film layer 72. Consequently, not only the heat-insulative layer 71 but also the inorganic-system coated-film layer 72 are enhanced in the heat-insulating property, and thereby the heat-insulating property of the heat-insulation coating film upgrades as a whole.

Sixth Embodiment Mode

Figure 4:
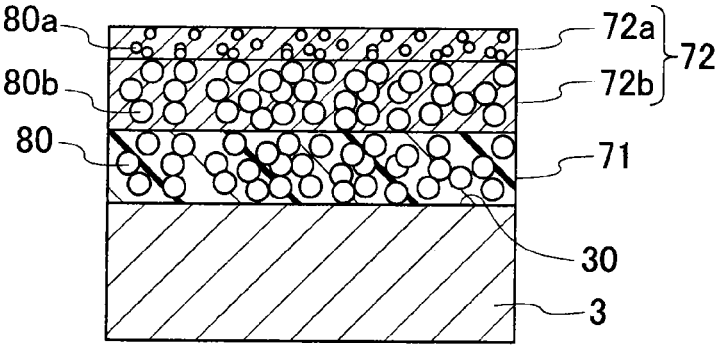
FIG. 4 is directed to Sixth Embodiment Mode, and is a cross-sectional diagram schematically illustrating the vicinity of a heat-insulation coating film formed on the top face of a piston.

Since the present embodiment mode comprises the same constituents as those of First Embodiment Mode basically, it can be described with reference to FIG. 1. As illustrated in FIG. 4, an engine according to the present embodiment mode comprises a first heat-insulation coating film 7*f* coated on almost all the entire area of a top face 30, one of the wall faces of a piston 3 disposed face-to-face to a combustion chamber 10. The first heat-insulation coating film 7*f* includes a heat-insulative layer 71 coating the top surface 30, and an inorganic-system coated-film layer 72 coating the heat-insulative layer 71. The heat-insulative layer 71 is composed of a resin, and first hollow particles buried in the resin and having a size on the order of micrometer.

As for the resin, one of the following can also be used: amino resins, polyaminoamide resins, phenolic resins, xylene resins, or furan resins, and the like. Moreover, taking the heat resistance and thermal-decomposition temperature into consideration, the following are preferable: epoxy resins, silicone resins, polyether imides, polyether sulfones, polyether ketones, polyether ether ketones, or ployamide-imides. When being used in much higher temperature environments, the following are more preferable: polybenzimidazoles, thermoplastic polyimides, and non-thermoplastic polyimides. In addition, the resin can most preferably be a thermoplastic polyimide, or a non-thermoplastic polyimide, which is obtainable from pyromellitic dianhydride or biphenyltetracarboxylic dianhydride excelling in the heat resistance.

For the first hollow particles 80, ceramic balloons, such as silica balloons or alumina balloons, are used. The first hollow particles 80 are micrometer-size hollow particles on the order of micrometer to exhibit an average particle diameter of 1 μm or more. The first hollow particles 80 are smaller than a thickness of the heat-insulative layer 71. An average particle diameter of the first hollow particles 80 is smaller than the thickness of the heat-insulative layer 71. It is allowable that the average particle diameter of the first hollow particles 80 can be from 1 μm or more to 100 μm or less; and moreover it is preferable that the average particle diameter can be from 1 μm or more to 50 μm or less. It is possible to set a range of the particle diameters of the first hollow particles 80 at 1 μm or more; but the range can preferably be from 1 to 300 μm, or can more preferably be from 1 to 150 μm.

The inorganic-system coated-film layer 72 comprises an inorganic compound, and second hollow particles (80*a*, 80*b*) buried in the inorganic compound. A thickness of the inorganic-system coated-film layer 72 is from 10 to 300 μm. The inorganic compound includes at least one member selected from the group consisting of silica, alumina, zirconia, and titania. The second hollow particles (80*a*, 80*b*) are inorganic-system particles, and are ceramic balloons such as silica balloons or alumina balloons. An average particle diameter of the second hollow particles 80*a*, one of the second hollow particles (80*a*, 80*b*), is smaller than an average particle diameter of the second hollow particles 80*b*, the other one of them.

The inorganic-system coated-film layer 72 comprises: an outermost superficial-layer section 72*a* in the inorganic-system coated-film layer 72; and an interior section 72*b* in the inorganic-system coated-film layer 72 disposed on a more inner side than is the outermost superficial-layer section 72*a* in a thickness-wise direction of the inorganic-system coated-film layer 72, and disposed face-to-face to the heat-insulative layer 71. A thickness of the outermost superficial-layer section 72*a* is from 1 to 100 μm, whereas a thickness of the interior section 72*b* is from 9 to 290 μm.

The second hollow particles 80*a*, one of the second hollow particles (80*a*, 80*b*), are included in the outermost superficial-layer section 72*a*, whereas the second hollow particles 80*b*, the other one of them, are included in the interior section 72*b*.

The second hollow particles 80*a* included in the outermost superficial section 72*a* of the inorganic-system coated-film layer 72 are nanometer-size hollow particles whose average particle diameter is less than 1 μm. It is possible to set the average particle diameter of the second hollow particles 80*a* at from 10 to 500 nm, or especially at from 30 to 150 nm. However, it shall not be limited to these at all. It is possible to set a range of the nanometer-size hollow particles' particle diameters at less than 1 μm; but it is preferable to set it at from 1 to 500 nm, or from 5 to 300 nm; and it is more preferable to set it at from 30 to 150 nm. It is possible to set a thickness of a shell of the hollow particles 80*a* at from 1 to 50 nm, or from 5 to 15 nm. The "average particle diameter" refers to a simple average of particle diameters in an electron microscope observation. As to a lower limit of the average particle diameter of the hollow particles 80*a*, it is possible to set it at 8 nm or 9 nm, whereas, as to an upper limit thereof, it is possible to set it at 600 nm or 800 nm.

The second hollow particles 80*b* included in the interior section 72*b* of the inorganic-system coated-film layer 72 are micrometer-size hollow particles whose average particle diameter is 1 μm or more. It is possible to set the average particle diameter of the hollow particles 80*b* at from 1 μm to 500 μm, or especially at from 1 μm to 100 μm. However, it shall not be limited to these at all. The "average particle diameter" refers to a simple average of particle diameters in an electron microscope observation. It is possible to set a range of the particle diameters of the second hollow particles 80*b* at 1 μm or more; but it is preferable to set it at from 1 μm to 300 μm; and it is more preferable to set it at from 1 μm to 150 μm. It is possible to set a thickness of a shell of the hollow particles 80*b* at from 10 nm to 30,000 nm, or from 100 nm to 15,000 nm. As to a lower limit of the average particle diameter of the hollow particles 80*b*, it is possible to set it at 1 μm, whereas, as to an upper limit thereof, it is possible to set it at 100 μm or 50 μm.

In the heat-insulative layer 71 according to the present embodiment mode, instead of the first nanometer-size hollow particles 70, micrometer-order first hollow particles 80 are included. The first hollow particles 80 included in the heat-insulative layer 71 are ceramic balloons such as silica balloons or alumina balloons. It is possible to set an average particle diameter of the first hollow particles 80 at from 1 μm to 500 μm, or especially at from 1 μm to 100 μm. However, it shall not be limited to these at all. For the first hollow particles 80, it is also allowable to use the same hollow particles as the second hollow particles 80*b* included in the interior section 72*b* of the inorganic-system coated-film layer 72, or it is even permissible to use different hollow particles. Other than the above, the present embodiment mode comprises the same constituents as those of First Embodiment Mode basically.

The hollow particles are included not only in the heat-insulative layer 71 but also in the inorganic-system coated-film layer 72. Consequently, not only the heat-insulative layer 71 but also the inorganic-system coated film layer 72 become higher in the heat-insulating property, and thereby the heat-insulating effect of the heat-insulation coating film upgrades as a whole. The second hollow particles 80*a* included in the outermost superficial section 72*a* of the inorganic-system coated-film layer 72 are smaller than the average particle diameter of the second hollow particles 80*b* included in the interior section 72*b* of the inorganic-system coated-film layer 72. Consequently, it is possible to upgrade the inorganic-system coated-film layer more in the superficial flatness/smoothness.

EMBODIMENTS

Hereinafter, embodiments embodying the present invention more will be explained.

First Embodiment

Figure 5:
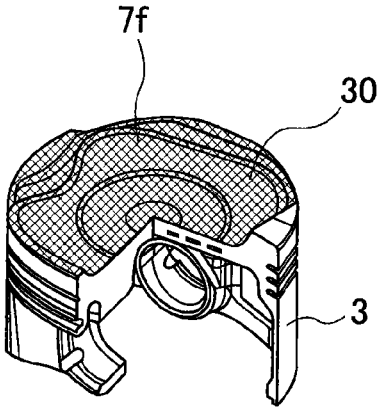
FIG. 5 is a perspective explanatory diagram of a piston according to First Embodiment on the top-face side.
Figure 6:
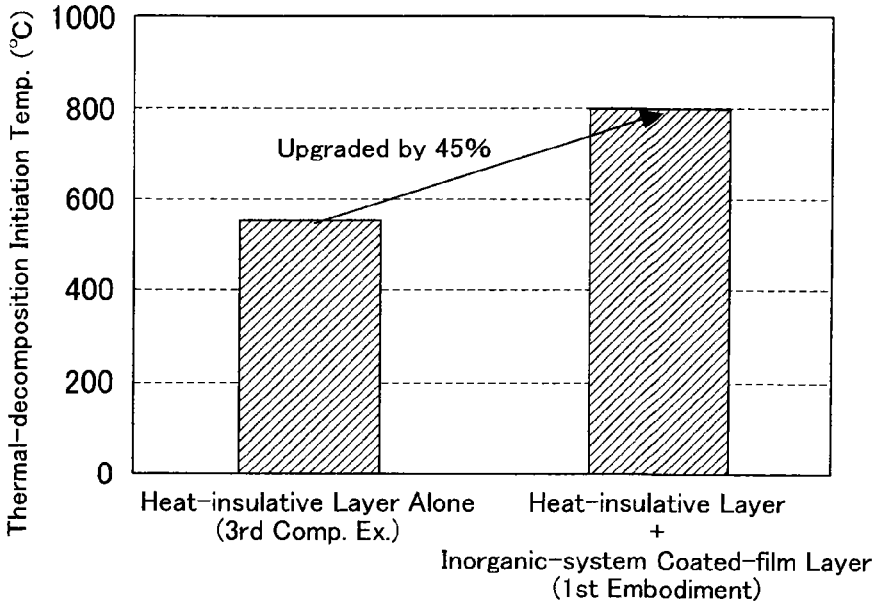
FIG. 6 is a graph showing results of a heat-resistance test for heat-insulation coating films according to First Embodiment and Third Comparative Example.

As First Embodiment, a heat-insulation coating film 7*f* directed to the present invention was applied on a top surface 30, one of the faces of a piston 3 disposed face-to-face to a combustion chamber, as shown in FIG. 5, and thereafter evaluations were carried out thereto. A quality of material used for the piston 3 was an aluminum-silicon-magnesium-copper-nickel-based alloy including silicon in an amount of from 11 to 13% by mass (as per JIS AC-8A). The heat-insulation coating film 7*f* was formed on the entirety of the top face 30 of the piston 3, as shown by the meshed portion in FIG. 5.

As illustrated in FIG. 2A, the heat-insulation coating film 7*f* comprised a heat-insulative layer 71 coating the top face 30 of the piston 3, and an inorganic-system coated-film layer 72 coating a surface of the heat-insulative layer 71. A thickness of the heat-insulative layer 71 was set at 200 μm. As for a resin functioning as a binder, a non-thermoplastic polyimide was employed. As shown in Table 2, nanometer-size hollow particles were blended in an amount of 25 parts by mass with respect to the resin taken as 100 parts by mass. As for the nanometer-size hollow particles, silica balloons were employed. The nanometer-size hollow particles were set to exhibit a particle-diameter range of from 30 to 150 nm, an average particle diameter of 108 nm, and a shell thickness of from 5 to 15 nm.

The inorganic-system coated-film layer 72 was a coated film comprising silica and having a thickness of 20 μm.

Upon forming the heat-insulation coating film directed to First Embodiment, the resin was made to exhibit a lower viscosity by dissolving it in a solvent (e.g., N-methyl-2-pyrrolidone), and then a paint was formed by mixing the nanometer-size hollow particles with the resulting mixture to disperse them therein with a disperser (e.g., an ultrasonic disperser). A paint film was formed by applying such a paint onto the top face of the piston with a spray, and the like. Thereafter, the paint film was baked by an electric furnace at a predetermined temperature (e.g., from 170 to 190° C.) for a predetermined time (e.g., from 0.5 to 2 hours), thereby forming the heat-insulative layer 71. Next, the inorganic-system coated-film layer 72 comprising silica was formed on a surface of the heat-insulative layer 71.

As to an average particle diameter of the nanometer-size hollow particles included in the heat-insulative layer 71, the nanometer-size hollow particles' average particle diameter was measured by observing the nanometer-size hollow particles with an electron microscope (e.g., FE-SEM) after the heat-insulation coating film had been ground with a cross-section polisher. A number "n" of the nanometer-size hollow particles to be measured was set at 20 to find their simple average. The nanometer-size hollow particles were blended so that a porosity made 60% by volume in the heat-insulative layer when an apparent volume of the heat-insulative layer within the heat-insulation coating film was taken as 100%. In this instance, voids demarcated by the nanometer-size hollow particles' shell were computed as the porosity.

Second Embodiment

As Second Embodiment, in the same manner as First Embodiment, a heat-insulation coating film 7*f* directed to the present invention was applied on a top surface 30, one of the faces of a piston 3 disposed face-to-face to a combustion chamber, and thereafter evaluations were carried out thereto. A quality of material used for the piston 3 was an aluminum-silicon-magnesium-copper-nickel-based alloy including silicon in an amount of from 11 to 13% by mass (as per JIS AC-8A). The heat-insulation coating film 7*f* was formed on the entirety of the top face 30 of the piston 3, as shown by the meshed portion in FIG. 5.

As illustrated in FIG. 4, the heat-insulation coating film 7*f* comprised a heat-insulative layer 71 coating the top face 30 of the piston 3, and an inorganic-system coated-film layer 72 coating a surface of the heat-insulative layer 71. A thickness of the heat-insulative layer 71 was set at 100 μm. As for a resin functioning as a binder, a non-thermoplastic polyimide was employed. As shown in Table 2, first hollow particles 80 were blended in an amount of 130 parts by mass with respect to the resin taken as 100 parts by mass. As for the first hollow particles, silica balloons were employed. The first hollow particles were set to exhibit a particle-diameter range of from 1 μm to 100 μm, an average particle diameter of 19,760 nm, and a shell thickness of from 100 to 5,000 nm.

The inorganic-system coated-film layer 72 comprised silica, and second hollow particles (80*a*, 80*b*). The inorganic-system coated-film layer 72 included an outermost superficial-layer section 72*a*, and an interior section 72*b* positioned on an inner side more than was the outermost superficial-layer section 72*a* positioned in the thickness-wise direction. The outermost superficial-layer section 72*a* was composed of silica, and the second hollow particles 80*a* dispersed in the silica. The interior section 72*b* was composed of silica, and the second hollow particles 80*b* dispersed in the silica. Any of the second micrometer-size hollow particles (80*a*, 80*b*) comprised silica balloons. The second hollow particles 80*a* included in the outermost superficial-layer section 72*a* were nanometer-size hollow particles having a size on the order of nanometer to exhibit less than 1 μm. The second hollow particles 80*a* were made to exhibit a particle-diameter range of from 30 to 150 nm, an average particle diameter of 108 nm, and a shell thickness of from 5 to 15 nm. The second hollow particles 80*b* included in the interior section 72*b* were micrometer-size hollow particles having a size on the order of micrometer to exhibit 1 μm or more. The second hollow particles 80*b* had an average particle diameter of 19,760 nm, a particle-diameter range of from 1 μm to 100 μm, and a shell thickness of from 100 nm to 5,000 nm.

A thickness of the outermost superficial-layer section 72*a* was 20 μm, whereas a thickness of the interior section 72*b* was 100 μm. When the silica within the outermost superficial-layer section 72*a* was taken as 100 parts by mass, a content of the second hollow particles 80*a* within the outermost superficial-layer section 72*a* was 7 parts by mass. When the silica within the interior section 72*b* was taken as 100 parts by mass, a content of the second hollow particles 80*b* within the interior section 72*b* was 95 parts by mass.

Upon forming the heat-insulation coating film directed to Second Embodiment, the resin was made to exhibit a lower viscosity by dissolving it in a solvent (e.g., N-methyl-2-pyrrolidone), and then a paint was formed by mixing the nanometer-size hollow particles with the resulting mixture to disperse them therein with a disperser (e.g., an ultrasonic disperser). A paint film was formed by applying such a paint onto the top face of the piston with a spray, and the like. Thereafter, the paint film was baked by an electric furnace at a predetermined temperature (e.g., from 170 to 190° C.) for a predetermined time (e.g., from 0.5 to 2 hours), thereby forming the heat-insulative layer 71. Next, the interior section 72*b* comprising the silica and second hollow particles 80*b* was formed on a surface of the heat-insulative layer 71. Next, the outermost superficial-layer section 72*a* comprising the silica and second hollow particles 80*a* was formed on a surface of the interior section 72*b*.

An average particle diameter of the hollow particles included in the heat-insulative layer 71 was measured. The hollow particles' average particle diameter was measured by observing the hollow particles with an electron microscope (e.g., FE-SEM) after the heat-insulation coating film had been ground with a cross-section polisher. A number "n" of the hollow particles to be measured was set at 20 to find their simple average. The hollow particles were blended so that a porosity made 78% by volume in the heat-insulative layer when an apparent volume of the heat-insulative layer within the heat-insulation coating film was taken as 100%. In this instance, voids demarcated by the nanometer-size hollow particles' shell were computed as the porosity.

When a porosity of the outermost superficial-layer section 72*a* in the inorganic-system coated-film layer 72 and that of the interior section 72*b* were measured as well, the outermost superficial-layer section 72*a* had a porosity of 12%, whereas the interior section 72*b* had a porosity of 80%.

Regarding First and Second Embodiments, a thermal conductivity of the heat-insulation coating film, a surface roughness "Ra" thereof, a likelihood of knocking, and a mileage were evaluated, and were shown in Table 2. As to the "mileage," relatively-expressed values, which were found with respect to a conventional engine' mileage being taken as 100, was labeled the "mileages". Conditions of the mileage measurement were as described below.

A used engine had following engine specifications (i) below, and comprised pistons (ii) below:

(i) in-line 4-cylinder, water cooled, DOHC, 16-valve, and 1,300-c.c. 4-cycle-engine displacement; and (ii) all of the four pistons had a 125-μm-thickness heat-insulation coating film directed to the present invention formed by application on the top face (i.e., one of the pitons' wall faces disposed face-to-face to the combustion chambers).

Mileages were evaluated under the following conditions: the mileages were measured for the cold-started engine, and were then averaged in a period between when the engine-coolant temperature was room temperature and when it rose to 88° C. In this instance, the engine was revolved constantly at a constant revolving speed of 2,500 rpm, and thereby a constant load was applied thereto.

First, Second and Third Comparative Examples were also evaluated similarly, and results are shown in Table 2. With regard to First Comparative Example, no treatment was performed to the top face of the pistons, and accordingly no heat-insulation coating film was formed thereon at all. With regard to Second Comparative Example, zirconia was flamed sprayed onto the top face of the pistons, and accordingly a frame-sprayed film was formed thereon.

With regard to Third Comparative Example, no inorganic-system coated-film layer was formed, although the heat-insulative layer 71 was formed on the top face 30 of the pistons 3. An average particle diameter of the nanometer-size hollow particles included in the heat-insulative layer 71 was set at 108 nm, and a content of the nanometer-size hollow particles was set at 14 parts by mass when the binder was taken as 100 parts by mass. A porosity of the heat-insulative layer 71 was set at 15%. A thickness of the heat-insulative layer 71 was set at 125 μm.

In First Comparative Example, the thermal conductivity was so large to be 130 W/mK, and the surface roughness was 4.82 expressed in "Ra," as shown in Table 2. Knocking did not occur. The mileage was expressed relatively with respect to 100.

In Second Comparative Example, the thermal conductivity of the zirconia frame-sprayed film was 4.0 W/mK, and was larger by about 25 times (=4.0 (W/mK)/0.16 (W/mK)) when compared with that of one of the present embodiments. The surface roughness of the frame-sprayed film was 38 expressed in "Ra," and was quite larger than that of First Embodiment. In Second Comparative Example, knocking occurred in the engine, and the mileage measurement had resulted in being unmeasurable.

In Third Comparative Example, the thermal conductivity was smaller remarkably than those of First and Second Comparative Examples, but was slightly higher compared with that of First Embodiment. The surface roughness of the heat-insulation coating film was smaller than those of First and Second Comparative Examples, but was slightly larger compared with that of First Embodiment. This resulted from flattening the irregularities in the heat-insulative layer's surface by the inorganic-system coated-film layer.

Third Comparative Example was free from knocking, and the mileage was better than that of First Comparative Example. However, the mileage was slightly poorer than that of First Embodiment.

On the contrary, in First Embodiment, the thermal conductivity of the heat-insulation coating film was so small to be 0.14 W/mK, and was smaller by about $1.1\times10^{-3}$ times (=0.14 (W/mK)/130 (W/mK)) when compared with that of First Comparative Example, and was smaller by about 0.035 times (=0.14 (W/mK)/4.0 (W/mK)) when compared with that of Second Comparative Example. The surface roughness of the heat-insulation coating film according to First Embodiment was 1.70 expressed in "Ra," and was smaller than those of First and Second Comparative Examples. In First Embodiment, knocking did not occur, and the mileage was 102.8.

In Second Embodiment, the thermal conductivity was smaller than that of First Embodiment, and accordingly the mileage was also upgraded. This is believed to result from making the blended ratio of the hollow particles included in the heat-insulative layer and inorganic-system coated-film layer greater than that in First Embodiment, so that Second Embodiment demonstrated higher heat-insulation performance than First Embodiment did. Second Embodiment exhibited the surface roughness heightened slightly more than First Embodiment did. This is believed to result from adding the hollow particles to the inorganic-system coated-film layer as well.

layer leads to enhancing the heat-insulative layer in the heat-insulating property. The reason is believed to be as follows. The inorganic-system coated-film layer is constituted of an inorganic compound so that it does not include any organic component. Consequently, the inorganic-system coated-film layer is less likely to decompose even under high temperatures. Coating the heat-insulative layer with the inorganic-system coated-film layer results in relieving the influences of heats applied to the heat-insulative layer, thereby suppressing the heat-insulative layer from decomposing thermally. The non-thermoplastic polyimide included in the heat-insulative layer exhibits the highest heat resistance even among resins. Since the heat-insulative layer is coated by the inorganic-system coated-film layer, resinous components within the heat-insulative layer are further

TABLE 2

| | | | 1st Comp. Ex. No Treatment | 2nd Comp. Ex. Zirconia Flame Spray | 3rd Comp. Ex. Heat-insulative Layer Alone | 1st Embodiment Heat-insulative Layer + Inorganic-system Coated-film Layer | 2nd Embodiment Heat-insulative Layer + Inorganic-system Coated-film Layer |
|---|---|---|---|---|---|---|---|
| Coating Film | Heat-insulative Layer | Binder Resin (Parts by Mass) | — | — | 100 | 100 | 100 |
| | | Hollow Particles (Parts by Mass) | — | — | 14 | 2.5 | 130 |
| | | Ave. Parti. Dia. of Hollow Particles (nm) | — | — | 108 | 108 | 19760 |
| | | Porosity of Heat-insulation Layer (%) | — | — | 15 | 60 | 78 |
| | | Thickness of Heat-insulation Layer (μm) | — | 1417 | 125 | 200 | 100 |
| | Presence or Absence of Inorganic-system Coated-film Layer | | Absent | Absent | Absent | Present | Present |
| Measured Results | Thermal Conductivity (W/mK) | | 130 | 4.0 | 0.16 | 0.14 | 0.09 |
| | Surface Roughness "Ra" | | 4.82 | 38 | 1.79 | 1.70 | 1.92 |
| | Knocking | | None | Occurred | None | None | None |
| | Mileage | | 100 | Unmeasurable because Knocking Occurred | 102.5 | 102.8 | 108.2 |

It could be ascertained from the aforementioned measured results that the heat-insulation coating films directed to First and Second Embodiments not only lower the thermal conductivity of the pistons on the top-face side but also they effect an advantage of reducing the surface roughness to reduce the occurrence of knocking.

Next, a heat-resistance test was carried out for the heat-insulation coating films according to First Embodiment and Third Comparative Example. In the heat-resistance test, temperatures at which the heat-insulation coating films started decomposing thermally were examined using an apparatus for thermogravimetric measurement.

The heat-insulation coating film comprising the heat-insulative layer and inorganic-system coated-film layer according to First Embodiment did not decompose thermally until it became about 800° C. On the other hand, the heat-insulation coating film comprising the heat-insulative layer alone according to Third Comparative Example started decomposing thermally at about 550° C. When the thermal-decomposition temperature of the heat-insulation coating film according to Third Comparative Example, which comprised the heat-insulative layer alone, was taken as 100%, the thermal-decomposition temperature of the heat-insulation coating film according to First Embodiment, which was made by coating the heat-insulative layer with the inorganic-system coated-film layer, become even 45% as higher.

From the above, it was understood that coating the heat-insulative layer with the inorganic-system coated-film inhibited from decomposing thermally, thereby raising the heat resistance of the heat-insulative layer.

As described above, coating the heat-insulative layer by the inorganic-system coated-film layer resulted in enhancing the heat-insulative layer in the heat resistance. Consequently, like First Embodiment shown in Table 2, it is possible to make the heat-insulative layer thicker, and thereby it is possible to enhance the heat-insulating effect. Moreover, when blending the hollow particles more, cracks are likely to arise in the heat-insulative layer. However, in First Embodiment, even if cracks should have arisen in the heat-insulative layer, it is possible to inhibit the hollow particles from dropping off from the heat-insulative layer, because it is coated with the inorganic-system coated-film layer. Hence, it is possible to heighten the blending amount of the hollow particles inside the heat-insulative layer, and moreover it is possible to enhance the heat-insulation performance.

(Engine Torque and Thermal Efficiency)

Relationships between the torques and thermal efficiencies of the engines according to Second Embodiment and First Comparative Example were measured. As set forth above, Second Embodiment comprised the pistons in which the heat-insulation coating film including the heat-insulative layer and inorganic-system coated-film layer was formed on the top face, whereas First Comparative Example comprised the pistons in which no treatment was performed to the top face.

Figure 7:
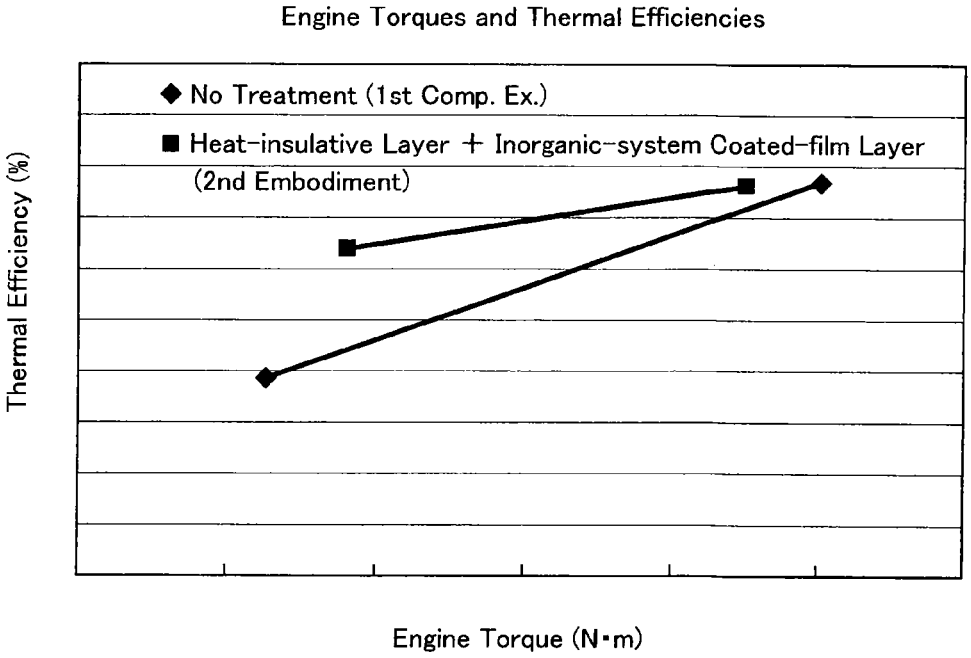
FIG. 7 is a linear diagram showing relationships between the engine torques and thermal efficiencies of engines according to Second Embodiment and First Comparative Example.

The torques of the engines were forces that the pistons, which received pressures in the combustion chambers, exerted to rotate the crankshaft, and the torques were measured mechanically by a torque meter that was coupled to the crankshaft by way of the propeller shaft. The "thermal efficiencies" refer to percentages of energy, which the engines outputted, when the entirety of energy, which the fuel held, was taken as 100. FIG. 7 illustrates relationships between the engines' torques and thermal efficiencies.

As shown in FIG. 7, Second Embodiment exhibited higher thermal efficiencies for engine torques, compared with those of First Comparative Example. When the engine torques are small, the rates of combustion within the combustion chambers become slow. If such is the case, heat radiations have great influences. Under such circumstances where the engine torques were small, Second Embodiment exhibited thermal efficiencies heightened remarkably, compared with those of First Comparative Example. Because of these facts, it was understood that Second Embodiment can suppress heat radiations when the engine torques are small.

Others

In accordance with First Embodiment Mode, even though the first heat-insulation coating film 7*f* is formed on the entire area of the top face 30 of the piston 3, it can also be formed on some of the parts of the top face 30. The present invention shall not be limited to the embodiment modes and embodiments having been described above and illustrated in the drawings alone, and accordingly it is possible to execute the present invention while making alterations suitably thereto within a range not departing from the gist.

EXPLANATION ON REFERENCE NUMERALS

"1" designates an engine; "10" designates a combustion chamber; "2" designates a cylinder block; "20" designates a bore; "3" designates a piston; "30" designates a top face; "4" designates a cylinder head; "40" designates a valve bore; "5" designates a valve; "7*f*" designates a heat-insulation coating film, respectively. Moreover, "70" designates nanometer-size hollow particles (i.e., first hollow particles); "71" designates a heat-insulative layer; "72" designates an inorganic-system coated-film layer; "72*a*" designates an outermost superficial-layer section; "72*b*" designates an interior section; "80" designates first hollow particles; and "80*a*" & "80*b*" designate second hollow particles, respectively.

The invention claimed is:

1. An engine comprising:
- a cylinder block having a bore;
- a piston fitted into said bore to reciprocate therein so as to form a combustion chamber therein;
- a cylinder head having a valve bore closing said combustion chamber and communicating with said combustion clamber; and
- a valve opening and closing said valve bore;
- at least one of said piston, said cylinder head and said valve having a wall face disposed face-to-face to said combustion chamber and a heat-insulation coating film coating said wall face;
- said heat-insulation coating film comprising:
  - a heat-insulative layer formed on a surface of said wall face; and
  - an inorganic-system coated-film layer formed on a surface of the heat-insulative layer;
- said heat-insulative layer comprising:
  - a resin; and
  - first hollow particles buried into the resin and exhibiting an average particle diameter being smaller than a thickness of said heat-insulative layer; and
- said inorganic-system coated-film layer comprising:
  - an inorganic compound and
  - second hollow particles exhibiting an average particle diameter being smaller than a thickness of said inorganic-system coated-film layer;
- said inorganic-system coated-film layer comprising an outermost superficial-layer section and an interior section disposed on a more inner side than the outermost superficial-layer section therein in a thickness-wise direction thereof and disposed face-to-face to said heat-insulative layer; and
- an average particle diameter of said second hollow particles included in said outermost superficial-layer section is smaller than an average particle diameter of said second hollow particles included in said interior section.

2. The engine as set forth in claim 1, wherein the average particle diameter of said first hollow particles falls within a range of 1 μm to 100 μm.

3. The engine as set forth in claim 1, wherein the thickness of said organic system coated-film layer is from 10 μm to 300 μm.

4. The engine as set forth in claim 1, wherein said inorganic compound constituting said inorganic-system coated-film layer comprises one or more members selected from silica, zirconia, alumina, and cerin.

5. The engine as set forth in claim 1, wherein the average particle diameter of said second hollow particles included in the outermost superficial-layer section falls within a range from 10 nm to 500 nm.

6. The engine as set forth in claim 1, wherein:
- the thickness of said heat-insulative layer is from 10 μm to 2,000 μm; and
- the average particle diameter of said first hollow particles is from 1 μm to 100 μm.

7. The engine as set forth in claim 1, wherein said heat-insulative layer exhibits a porosity, of from 5% or more to 90% or less when an apparent volume of said heat-insulative layer is taken as 100%.

8. The engine as set forth in claim 1, wherein a surface roughness of said outermost superficial-layer section of said inorganic system coated-film layer included in said heat-insulation coating film is smaller than another surface roughness of the wall face.

9. A piston fitted into a bore to reciprocate therein so as to form a combustion chamber therein, said piston comprising:
- a wall face disposed face-to-face to said combustion chamber and coated by a heat-insulation coating film coating said wall face, said heat-insulation coating film comprising:
  - a heat-insulative layer formed on a surface of said wall face; and
  - an inorganic-system coated-film layer formed on a surface of the heat-insulative layer, said heat-insulative layer comprising:
    - a resin; and
    - first hollow particles buried into the resin and exhibiting an average particle diameter being smaller than a thickness of said heat-insulative layer; and
  - said inorganic-system coated-film layer comprising:
    - an inorganic compound and second hollow particles exhibiting an average particle diameter being smaller than a thickness of said inorganic-system coated-film layer, said inorganic-system coated-film layer comprising an outermost superficial-layer section and an interior section disposed on a more inner side than is the outermost superficial-layer section therein in a thickness-wise direction thereof and disposed face-to-face to said heat-insulative layer; and an average particle diameter of said second hollow particles included in said outermost superficial-layer section is smaller than an average particle diameter of said section hollow particles included in said interior section.

10. The piston as set forth in claim 9, wherein a surface roughness of said inorganic-system coated-film layer included in said heat-insulation coating film is smaller than another surface roughness of the wall face.

11. The engine as set forth in claim 1, wherein said inorganic-system coated-film layer is a coating film comprising silica.

12. The engine as set forth in claim 1, wherein the average particle diameter of said second hollow particles included in said interior section falls within a range from 1 μm to 500 μm.

13. The engine as set forth in claim 10, wherein said inorganic-system coated-film layer is a coating film comprising silica.

* * * * *